US007496308B2

(12) United States Patent
Tanabe

(10) Patent No.: US 7,496,308 B2
(45) Date of Patent: Feb. 24, 2009

(54) IMAGE TRANSFERRING AND FORMING APPARATUS

(75) Inventor: Tsuyoshi Tanabe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 124 days.

(21) Appl. No.: 11/489,436

(22) Filed: Jul. 20, 2006

(65) Prior Publication Data

US 2007/0020001 A1 Jan. 25, 2007

(30) Foreign Application Priority Data

Jul. 20, 2005 (JP) ..... 2005-210136
Jul. 29, 2005 (JP) ..... 2005-220305

(51) Int. Cl.
*G03G 15/20* (2006.01)
*G03G 15/00* (2006.01)

(52) U.S. Cl. ..... 399/68; 399/45; 399/322

(58) Field of Classification Search ..... 399/45, 399/68, 322, 328, 341
See application file for complete search history.

(56) References Cited

U.S. PATENT DOCUMENTS 6,721,532 B2 * 4/2004 Kosugi et al. ..... 399/341
6,850,727 B2 * 2/2005 Noya et al. ..... 399/328
6,980,762 B2 * 12/2005 Bogoshian ..... 399/328
7,197,271 B2 * 3/2007 Nakamura et al. ..... 399/341
7,233,765 B2 * 6/2007 Murai et al. ..... 399/341

FOREIGN PATENT DOCUMENTS

JP 58-126561 A 7/1983
JP 3-253882 A 11/1991
JP 2004-109860 A 4/2004

* cited by examiner

*Primary Examiner*—Sandra L Brase
(74) *Attorney, Agent, or Firm*—Birch, Stewart, Kolasch & Birch, LLP

(57) ABSTRACT

An image forming apparatus includes a transferring section for transferring an image to an image receiving medium, a primary fixing section for fixing the image by pressurizing the medium and a secondary fixing section for fixing the image. Conveying lengths of the medium from a transfer position to image fixing positions in the secondary fixing section and the primary fixing section are shorter than a maximum length and a minimum length of the medium in the conveying direction, respectively. In case of the medium of the maximum length, the primary fixing section is brought into a non-fixing state and the transfer is completed when the forward end of the medium reaches the secondary fixing section. In case of the medium of the minimum length, the primary fixing section is brought into a fixing state and the transfer is completed when the forward end of the medium reaches the primary fixing section.

6 Claims, 9 Drawing Sheets

IMAGE TRANSFERRING AND FORMING APPARATUS

BACKGROUND OF THE INVENTION

The present invention relates to an image forming apparatus employing a transfer process for transferring an image to an image receiving medium and a fixing process after the transfer, and more particularly, to an image forming apparatus which is capable of preventing an image unevenness from being caused during image transfer, and of being made compact.

There has been known an image forming method, such as an image recording method of an electrophotographic system, in which an image is first formed on an image formation medium or the image is further transferred from the image formation medium onto an intermediate transfer body from the image formation medium, and then the image is transferred from the image formation medium or the intermediate transfer body onto the image receiving medium (i.e., recording sheet) to be fixed onto the image receiving medium by the application of pressure.

In the image forming method in which an image is transferred as described above, load change occurred in the image receiving medium during the transfer of the image leads to an image unevenness (so-called banding), which deteriorates the quality of the image. Factors responsible for the load change that causes the banding include an impact given to the image receiving medium when the image receiving medium enters a downstream process during transfer (i.e., a forward end entry load), or a difference in speeds between downstream conveyance and transfer.

Specially, in recent years, as disclosed in JP 2004-109860 A (hereinafter referred to as Patent Document 1), for example, a print with quality as high as that of a silver halide photographic print even by the image forming method of an electrophotographic system, by adopting such means as giving a gloss to the image receiving medium.

In the print of high quality, the image unevenness becomes a serious problem, and thus it is significantly important to eliminate the occurrence of banding. However, since a thick image receiving medium is preferred for the print with the high image quality, the forward end entry load is large with the result that banding is liable to occur.

In order to suppress the banding, there have been proposed various methods of reducing or eliminating a load change caused while an image is being transferred onto the image receiving medium.

For example, JP 03-253882 A (hereinafter referred to as Patent Document 2) discloses an image forming apparatus for conducting transfer and fixing or the like with the application of pressure in electrophotography, in which a distance between the transfer position and the fixing position is made larger than a maximum length of the image receiving medium applicable, to thereby reduce deterioration of an image quality due to banding or the like.

Also, JP 58-126561 A (hereinafter referred to as Patent Document 3) discloses an image fixing device using a pressure in which an electromagnetic force is used in addition to a spring to make a pressure force variable. With the use of the above device, it may also be possible to reduce the banding by setting a pressure force to be low at the beginning, and by increasing the pressure force after the image receiving medium has entered the fixing device.

However, as disclosed in Patent Document 2, in order to make the distance (i.e., conveying length) between the transfer position and the fixing position larger than the maximum length of the medium, it is necessary to keep the distance large enough, which leads to an increase in size of the apparatus or an increase in cost. In particular, in a case of using plural kinds of image receiving media that are different in length, not only is it necessary to make the distance (i.e., conveying length) long between the transfer position and the fixing position, but it is also necessary to further provide conveying means such as a conveyor belt for conveying the image receiving medium that is smaller than the maximum size between the transfer position and the fixing position. This further causes the size or the cost of the apparatus to increase.

Also, in the fixing of the formed image in the electrophotographic system, it is necessary to maintain a pressure force at a certain strength. For that reason, when the method of changing the pressure force during fixing disclosed in Patent Document 3 is adopted, the load relationship among the respective processes (i.e., units) varies due to the load change caused at a fixing portion during fixing and conveying, which results in banding.

SUMMARY OF THE INVENTION

The present invention has been made to solve the problems with the conventional technique, and therefore has an object to provide an image forming apparatus capable of preventing image quality deterioration due to banding from occurring and suitably responding to the intended purposes of producing an image with high quality equal to that of a photograph, and also capable of preventing an increase in size of the apparatus so as to make the apparatus compact, in an image forming method such as that in the photographic system in which an image is transferred onto an image receiving medium, and then the transferred image is fixed.

In order to achieve the above objects, a first aspect of the present invention provides an image forming apparatus, including:

a transferring section that transfers an image to an image receiving medium at a given transfer position;

a primary fixing section that is disposed downstream of the transferring section, and is capable of bringing the transferred image into a fixing state where the image is fixed by pressurizing the image receiving medium, and into a non-fixing state; and a secondary fixing section that is disposed downstream of the primary fixing section, for fixing the transferred image by pressurizing the image receiving medium, wherein a conveying length of the image receiving medium from the transfer position to an image fixing position in the secondary fixing section is shorter than the length of the image receiving medium having a maximum length in the conveying direction, and a conveying length of the image receiving medium from the transfer position to a fixing position in the primary fixing section is shorter than the length of the image receiving medium having a minimum length in the conveying direction, and wherein when the image is formed on the image receiving medium of the maximum length, the primary fixing section is brought into the non-fixing state, and the transferring section transfers the image to such a position that the transfer is completed when the forward end of the image receiving medium reaches the secondary fixing section, and when the image is formed on the image receiving medium of the minimum length, the primary fixing section is brought into the fixing state, and the transfer section transfers the image to such a position that the transfer is completed when the forward end of the image receiving medium reaches the primary fixing section.

Here, preferably, the image forming apparatus further including an intermediate transferring section that is disposed between the primary fixing section and the secondary fixing section and is capable of bringing the image receiving medium into a nipping state where the image receiving medium is nipped and conveyed and into a release state.

In this case, preferably, when the image is recorded on the image receiving medium of the maximum length, the intermediate conveying section is brought into the release state until at least transfer is completed.

Further, preferably, when the image is formed on the image receiving medium whose length in the conveying direction is shorter than the length of the image receiving medium having the maximum length and longer than the length of the image receiving medium having the minimum length, the transferring section provides a margin at a rear end of the image receiving medium in the conveying direction and transfers the image to-the image receiving medium, and brings the primary fixing means into the non-fixing state, and the intermediate conveying section is initially in the release state, and brought into the nipping state after the transfer in the transferring section has been completed.

Alternatively, preferably, when the image is formed on the image receiving medium whose length in the conveying direction is shorter than the length of the image receiving medium having the maximum length and longer than the length of the image receiving medium having the minimum length, the intermediate conveying section is initially in the release state, and gradually brought into the nipping state after the forward end of the image receiving medium has reached the intermediate conveying section.

Alternatively, preferably, when a plurality of images are located at intervals in the conveying direction and formed on the image receiving medium whose length in the conveying direction is shorter than the length of the image receiving medium having the maximum length and longer than the length of the image receiving medium having the minimum length, the intermediate conveying section is initially in the release state, and brought into the nipping state at the time when the image receiving medium reaches the intermediate conveying section, and the transfer position is located between the images in the conveying direction.

In order to achieve the above objects, a second aspect of the present invention provides an image forming apparatus, including:

a transferring section that transfers an image to an image receiving medium at a given transfer position;

a fixing section that is disposed downstream of the transferring section and fixes the transferred image by pressurizing the image receiving medium; and one intermediate conveying means that is disposed between the transferring section and the fixing section and is capable of making the image receiving medium in a nipping state where the image receiving medium is nipped and conveyed, and a release state, wherein a conveying length of the image receiving medium from the transfer position to an image fixing position in the fixing section is shorter than the length of the image receiving medium having the maximum length in the conveying direction, and a conveying length of the image receiving medium from the transfer position to the one intermediate conveying means, and a conveying length from the one intermediate conveying means to the fixing position in the fixing section are shorter than the length of the image receiving medium having a minimum length in the conveying direction, and wherein when the image is formed on the image receiving medium of a maximum length, the one intermediate conveying section is made in the release state, and the transferring section transfers the image to such a position that the transfer is completed when the forward end of the image receiving medium reaches the fixing section, and when the image is formed on the image receiving medium of the minimum length, the one intermediate conveying means is made in the fixing state, and the transferring section transfers the image to such a position that the transfer is completed when the forward end of the image receiving medium reaches the one intermediate conveying means.

Preferably, the image forming apparatus of the second aspect of the present invention, further comprising:

at least one intermediate conveying means that is disposed between the transferring section and the fixing section and is capable of making the image receiving medium in a nipping state where the image receiving medium is nipped and conveyed, and a release state, wherein the one intermediate conveying means and the at least one intermediate conveying means are included in multiple intermediate conveying means, wherein a conveying length of the image receiving medium from the transfer position to an image fixing position in the fixing section is shorter than the length of the image receiving medium having the maximum length in the conveying direction, and a conveying length of the image receiving medium from the transfer position to the most upstream intermediate conveying means of the multiple intermediate conveying means, a conveying length of the image receiving medium between the multiple intermediate conveying means, and a conveying length from the most downstream intermediate conveying means to the fixing position in the fixing section are shorter than the length of the image receiving medium having a minimum length in the conveying direction, and wherein when the image is formed on the image receiving medium of a maximum length, the multiple intermediate conveying means are made in the release state, and the transferring section transfers the image to such a position that the transfer is completed when the forward end of the image receiving medium reaches the fixing section, and when the image is formed on the image receiving medium of the minimum length, the multiple intermediate conveying means are made in the fixing state, and the transferring section transfers the image to such a position that the transfer is completed when the forward end of the image receiving medium reaches the most upstream intermediate conveying means.

Further, preferably, the multiple intermediate conveying means can be driven independently of each other.

Further, preferably, the transferring section provides margins at end portions in a direction orthogonal to the conveying direction, and transfers the image onto the image receiving medium, and at least the nipping means at the image transfer surface side of the intermediate conveying means is movable in the direction orthogonal to the conveying direction to nip the margins at side ends of the image receiving medium.

Further, preferably, when the image is formed on the image receiving medium whose length in the conveying direction is shorter than the length of the image receiving medium having the maximum length and longer than the length of the image receiving medium having the minimum length, the transferring section provides a margin at a rear end of the image receiving medium in the conveying direction and transfers the image to the image receiving medium, and the intermediate conveying means is initially in the release state, and brought into the nipping state after the transfer in the transferring section has been completed.

Alternatively, preferably, when the image is formed on the image receiving medium whose length in the conveying direction is shorter than the length of the image receiving medium having the maximum length and longer than the length of the image receiving medium having the minimum length, the intermediate conveying means is initially in the release state, and gradually brought into the nipping state after the forward end of the image receiving medium has reached the intermediate conveying means.

Alternatively, preferably, when a plurality of images are located at intervals in the conveying direction and formed on the image receiving medium whose length in the conveying direction is shorter than the length of the image receiving medium having the maximum length and longer than the length of the image receiving medium having the minimum length, the intermediate conveying means is initially in the release state, and brought into the nipping state at the time when the image receiving medium reaches the intermediate conveying section, and the transfer position is located between the images in the conveying direction.

Further, preferably, the intermediate conveying means includes load reducing means for making the conveying load on the image receiving medium smaller than the conveying load on the image receiving medium in the transferring section.

According to the first and second aspects of the present invention with the above structures, it is possible to provide the image forming apparatus in which an image is first formed on an image formation medium or an intermediate transfer member to be transferred onto the image receiving medium (i.e., recording sheet) and then the transferred image is fixed onto the image receiving medium with the application of pressure (or further by heating) as in an image recording method of the electrophotographic system, capable of preventing banding (i.e., image unevenness) due to a load change of the image receiving medium during transfer from occurring, and also capable of being made compact according to the corresponding receiver media.

DETAILED DESCRIPTION OF THE PREFERRED EMBODIMENTS

Hereinafter, a description will be given in more detail of image forming apparatus according to preferred embodiments of the present invention with reference to the accompanying drawings.

First, an image forming apparatus according to the first aspect of the present invention will be described with reference to FIGS. 1 to 5B.

Figure 1:
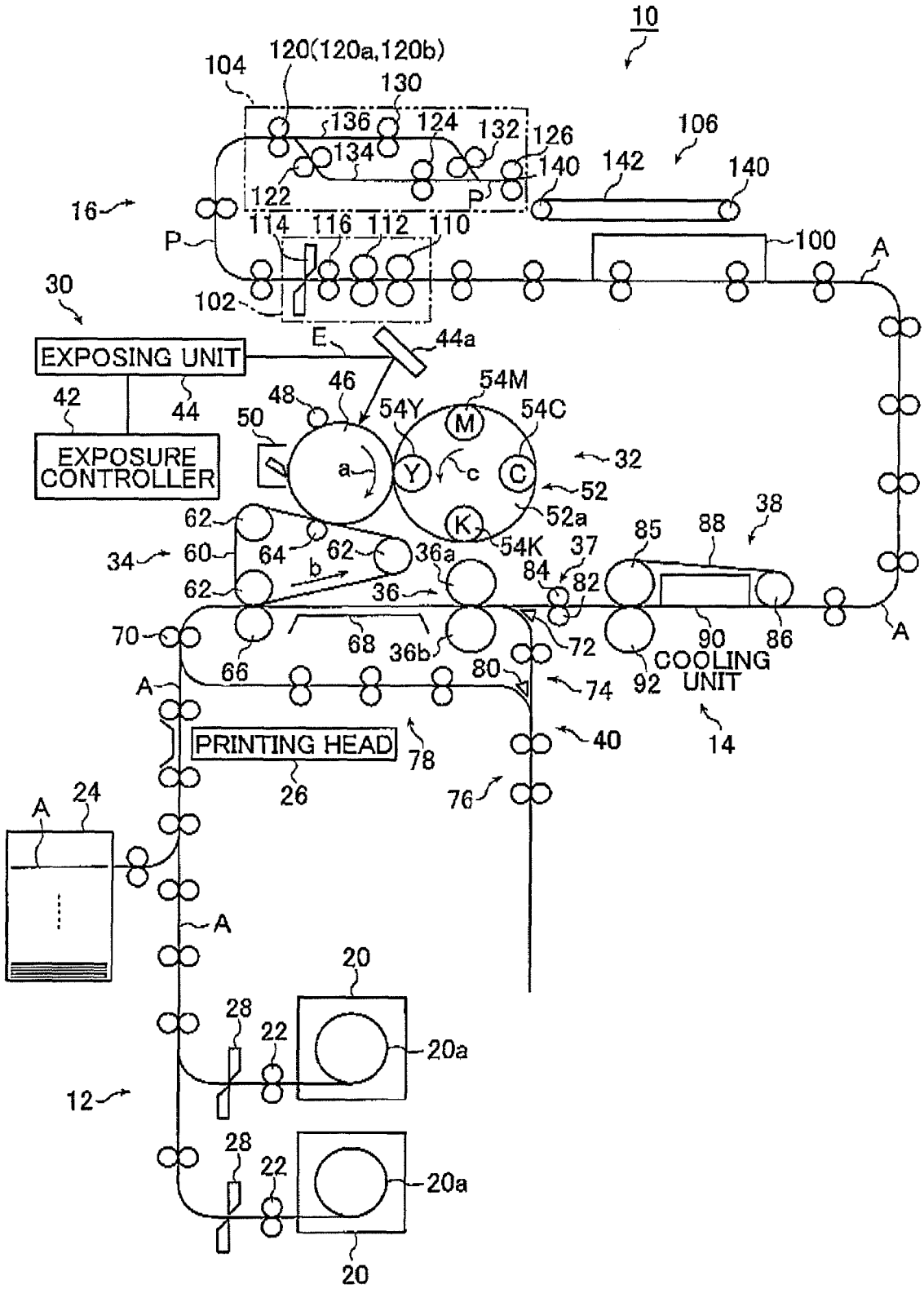
FIG. 1 is a conceptual diagram showing an embodiment of a printer using an image forming apparatus according to the present invention.

FIG. 1 is a conceptual diagram showing an embodiment of a printer using an image forming apparatus of the first aspect of the present invention.

A printer 10 shown in FIG. 1 produces a print by recording an image on a recording sheet A or image receiving medium by an electrophotographic system and basically includes a recording sheet supplying section 12, an image forming section 14, and a cutting/arranging section 16. Various members arranged in commonly known printers as exemplified by means for conveying the recording sheet A (such as a conveying roller pair and a guide member) and a sensor for detecting the recording sheet A are also disposed as necessary in these sections or between the adjacent sections, although they are not specifically shown or denoted by reference numerals. Further, although being omitted from the drawing, the printer 10 includes control means for controlling the driving or operation of each section.

The printer 10 obtains finished prints by recording images corresponding to print sizes on the recording sheet A and then cutting the recording sheet A into the print sizes. Also, in the illustrated example, as a preferable form, the printer 10 imposes multiple images (e.g., two images or four images) on one recording sheet A, i.e., performs so-called multi-image imposition, according to need, and multiple prints are produced from one recording sheet A.

Also, in the printer 10, in order to keep the apparatus free of the contamination with unfixed toner or to prevent images from adversely affecting one another when plural images are recorded, each image is formed on the recording sheet A with margins provided in the periphery of the image. Therefore, the periphery of the recording sheet A (including the forward and rear ends in the conveying direction and both the lateral ends in a direction orthogonal to the conveying direction) is blank.

In the following description, for convenience' sake, the direction orthogonal to the conveying direction will be referred to as the "width direction" and the size of the recording sheet A in this direction will be referred to as the "width". The size of the recording sheet A in the conveying direction will be referred to as the "length". Further, the forward end and the rear end are determined with respect to the conveying direction.

The recording sheet supplying section 12 (hereinafter referred to as the "supplying section 12") is a section for supplying the cut recording sheet A to the image forming section 14.

In the illustrated embodiment, the supplying section 12 includes two loading units into which magazines 20 each accommodating a recording sheet roll 20*a* of the elongated recording sheet A is loaded, and a loading unit into which a cassette 24 accommodating the cut recording sheets A is loaded.

The loading units for the magazines 20 usually accommodate the recording sheet rolls 20*a* whose widths or sizes are different from each other. On the other hand, the cassette 24 is a case as used in various printers, which is loaded into the printer after accommodating the recording sheets A.

The recording sheet A used in the printer 10 is not specifically limited and all kinds of recording sheet or image receiving medium used in a printer adopting an electrophotographic system is usable.

Among them, a recording sheet on which a highly glossy print of photographic quality can be produced (hereinafter also referred to as the photo-like print sheet), such as a recording sheet obtained by forming a transparent resin layer made of a thermoplastic resin on at least one surface of a substrate made of paper or the like, is particularly suitable. For example, this recording sheet can be used to produce a highly glossy print like a silver halide photographic print by forming a toner image on the image forming surface of the transparent resin layer, applying heat and pressure to the transparent resin layer with a belt having an excellent surface smoothness to melt, and cooling and solidifying the transparent resin layer (the toner image may be optionally fixed) (see JP 05-216322 A).

Although not illustrated, each loading unit includes size detecting means for detecting the width (i.e. size) of the recording sheet roll 20*a* accommodated in the magazine 20, the size of the recording sheet A accommodated in the cassette 24, the kind of the recording sheet A (for example, whether the recording sheet A is plain paper or the photo-like print sheet) with a DIP switch, a barcode, or the like.

A drawing-out roller pair 22 and a cutter 28 are disposed downstream of each magazine 20 loaded into one of the loading units (i.e. downstream in the conveying direction of the recording sheet A).

The drawing-out roller pair 22 is a roller pair with which the recording sheet is drawn out of the recording sheet roll 20*a* accommodated in the magazine 20. The cutter 28 is known means for cutting sheets such as a guillotine cutter.

The drawing-out roller pair 22 stops drawing out the recording sheet from the recording sheet roll 20*a* when the recording sheet on the downstream side of the cutter 28 has a predetermined length. Next, the cutter 28 cuts the recording sheet into a predetermined size and the thus cut recording sheet A is supplied to predetermined conveying means.

As described above, in the printer 10, the image is formed on the recording sheet A in such a manner that margins are provided in the periphery of the image as described above. According to the present invention, it is possible that a cutout length of the recording sheet A is adjusted according to a print size (or an image size) or the like, to thereby create margins in the forward end and the rear end (in particular, the rear end) of the recording sheet A, and/or adjust the lengths of the margins.

The recording sheet A accommodated in the cassette 24 is drawn out by known means used in various printers and is supplied to predetermined conveying means.

The recording sheet A cut into the predetermined size with the cutter 28 and the recording sheet A drawn out of the cassette 24 are both conveyed to the image forming section 14 through conveying roller pairs.

A printing head 26 for back printing on the back surface (i.e. non-image-recording surface) of the recording sheet is disposed between two conveying roller pairs immediately upstream of the image forming section 14.

The printing head 26 is not specifically limited and various known printing means such as an impact printer using an ink ribbon and an ink jet printer are usable.

The image forming section 14 is a section where images are formed on the recording sheet A by electrophotography and includes an exposing subsection 30, a toner image forming subsection 32, a transferring subsection 34, a primary fixing roller pair 36, an intermediate conveying roller pair 37, a secondary fixing subsection 38, and a reversing subsection 40.

The image forming section 14 pertains to an image forming apparatus according to the first aspect of the present invention. In the image forming section 14, an interval (i.e., conveying distance) between a transfer position at which an image is transferred to the recording sheet A in the transferring subsection 34 and the primary fixing roller pair 36 is slightly shorter than a minimum length of the corresponding recording sheet A. In addition, an interval between the transfer position and the secondary fixing subsection 38 is slightly shorter than a maximum length of the corresponding recording sheet A. This feature will be described later.

The exposing subsection 30 includes an exposure controller 42 and an exposing unit 44.

The exposure controller 42 acquires images (image data) to be reproduced on prints from an image supply source, carries out predetermined image processing, and performs an image layout in accordance with the number of images to be recorded (i.e., the number of images for imposition) on one recording sheet A, thereby preparing images to be recorded on the one recording sheet A. As described above, since the printer 10 forms one or more images on the recording sheet A in such a manner that margins are provided in the periphery of the respective images, the exposure controller 42 imposes the images so as to provide given gaps between the respective images and also create margins in the forward end and rear end of the recording sheet A as well as at both lateral ends in the width direction (hereinafter referred to as side ends), in order to satisfy the above conditions.

On the other hand, the exposing unit 44 is a known light beam scanning optical system including a light source of a light beam (i.e. recording light) for exposing an electrophotographic photosensitive drum 46 of the toner image forming subsection 32 to be described later, a light deflector, an fθ lens, an optical path changing mirror, and a light beam adjusting lens.

That is, the exposing unit 44 deflects a light beam E modulated in accordance with image data (i.e. images to be recorded) supplied from the exposure controller 42 in a main scanning direction coinciding with the width direction (i.e. direction orthogonal to the conveying direction (in which the electrophotographic photosensitive drum 46 rotates). The deflected light beam E is emitted to and then reflected on a mirror 44a to be incident on the drum 46 at a predetermined exposure position, thereby recording a latent image on the electrophotographic photosensitive drum 46.

The toner image forming subsection 32 is a known subsection in which a toner image is formed by electrophotography and includes the electrophotographic photosensitive drum 46 (hereinafter referred to as the "photosensitive drum 46"), charging means 48, cleaning means 50, and toner supplying means 52.

The photosensitive drum 46 is a known electrophotographic photosensitive drum and is rotated in a direction indicated by an arrow "a" (i.e. direction opposite to the conveying direction of the recording sheet A) about a central axis coinciding with the width direction. As described above, the light beam E from the exposing unit 44 is deflected in the width direction, so the photosensitive drum 46 is two-dimensionally scanned by exposure to the light beam E modulated in accordance with the recorded image to be recorded.

The toner supplying means 52 includes four toner supplying units that are a C (cyan) toner supplying unit 54C, an M (magenta) toner supplying unit 54M, a Y (yellow) toner supplying unit 54Y, and a K (black) toner supplying unit 54K, with the toner supplying units being attached to a rotatable drum-shaped main body 52*a* at intervals of a 90° rotation angle.

The transferring subsection 34 includes a transfer belt 60 that is an endless belt partially abutted against the photosensitive drum 46, three rollers 62 around which the transfer belt 60 is stretched, a press roller 64 which presses the transfer belt 60 outward against the photosensitive drum 46, a transfer roller 66, and a conveying guide 68. The transfer belt 60 is an intermediate transfer member of the toner image and is rotated in a direction indicated by an arrow "b" (that is, the same direction as the direction in which the recording sheet A is conveyed) . The transfer roller 66 is movable between the position at which the transfer belt 60 (i.e. recording sheet A) is nipped between the transfer roller 66 and one of the rollers 62, and the position at which the transfer roller 66 is spaced apart from the transfer belt 60.

While being rotated in the direction indicated by the arrow "a" in FIG. 1, the photosensitive drum 46 is uniformly charged in the width direction by the charging means 48 and is two-dimensionally scanned by exposure to the light beam E modulated in accordance with the image data as described above, thereby forming an electrostatic latent image. Next, the electrostatic latent image is developed by one of the toner supplying units of the toner supplying means 52, such as the Y toner supplying unit 54Y, which is positioned at the developing position (i.e. at the position facing the photosensitive drum 46) and a toner image such as a Y toner image is formed on the surface of the photosensitive drum 46.

The transfer belt 60 that partially contacts the photosensitive drum 46 and is pressed by the press roller 64 against the photosensitive drum 46 is rotated in the direction indicated by the arrow "b" in synchronization with the rotation of the photosensitive drum 46. Accordingly, the toner image on the photosensitive drum 46 developed by the toner supplying means 52 is transferred onto the transfer belt 60 in the contact portion (at which the press roller 64 presses the belt). After the toner image on the photosensitive drum 46 has been transferred onto the transfer belt 60, the cleaning means 50 removes residual toner from the photosensitive drum 46.

In the illustrated embodiment, formation of toner images and their transfer onto the transfer belt 60 are performed by sequentially actuating the four toner supplying units including the Y toner supplying unit 54Y, the M toner supplying unit 54M, the C toner supplying unit 54C, and the K toner supplying unit 54K.

For instance, after the Y toner image has been transferred onto the transfer belt 60 in the manner described above, the toner supplying means 52 (more specifically its main body 52*a*) is rotated by 90° in the direction of the arrow "a" to set the M toner supplying unit 54M at the developing position. After performing positioning to match an M toner image with the Y toner image on the transfer belt 60, a latent image is formed on the photosensitive drum 46 and is developed to obtain the M toner image, which is then transferred onto the transfer belt 60. Subsequently, a C toner image and a K toner image are transferred onto the transfer belt in succession in the manner as described above. During this operation, the transfer roller 66 is spaced apart from the transfer belt 60.

Accordingly, in the illustrated embodiment, the Y, M, C, and K toner images are formed on the surface of the transfer belt 60 after positioning. In other words, a four-color (that is, a full-color) image is formed.

On the other hand, the recording sheet A cut into a predetermined size is supplied from the supplying section 12 and is placed under a standby state, for example, at a registration roller pair 70 immediately upstream of the transfer roller 66.

When a color image has been formed on the transfer belt 60, conveyance of the recording sheet A through the registration roller pair 70 is started in synchronization with the rotation of the transfer belt 60 so that the recording sheet A coincides in position with the color image formed on the transfer belt 60. In addition, the transfer roller 66 is pressed against the transfer belt 60 (roller 62) and the recording sheet A is conveyed while being nipped between the transfer belt 60 and the transfer roller 66. As a result of conveyance of the nipped recording sheet, four-color toner images formed on the surface of the transfer belt 60 are transferred onto the recording sheet A and a total image (including plural images) is formed on the surface of the recording sheet A.

As described above, the total image includes plural images imposed in accordance with the number of images to be recorded, and the images are also imposed in such a manner that the respective images have margins in the periphery thereof where no image is recorded. Therefore, given margins are provided in the periphery of the respective images that have been formed (i.e., transferred) on the recording sheet A, and margins are provided in the forward end, the rear end, and both lateral side ends of the recording sheet A.

The recording sheet A on which the image has been formed is conveyed on the conveying guide 68 to the primary fixing roller pair 36.

The primary fixing roller pair 36 is a pair of conveying rollers including two rollers 36*a* and 36*b* abutting against each other, and at least one of which is a heating roller. The roller 36*a* of the image recording surface side (i.e., upper side in the example shown in FIG. 1) of the recording sheet A is moved upward, thereby making it possible to make the rollers apart from each other to cancel the pressuring state (i.e., fixing state).

The recording sheet A on which the toner image has been formed is heated and pressurized while the recording sheet A is nipped and conveyed by the primary fixing roller pair 36. In the printer 10 according to the present invention, the primary fixing roller pair 36 fixes the image on the recording sheet A under heating and pressurization only in a case where a print is produced by using the photo-like print sheet of a minimum length, or the image is recorded by using the plain paper as the recording sheet A.

This feature will be described later.

The reversing subsection 40 is a subsection in which the recording sheet A on which images have been fixed by the primary fixing roller pair 36 are reversed to produce so-called double-sided prints. The reversing subsection 40 includes first switching means 72 disposed downstream of the primary fixing roller pair 36, a branching path 74 branching from the conveying path at the downstream position of the primary fixing roller pair 36, a kickback unit 76 provided downstream of the branching path 74, a return conveying path 78 that branches from the branching path 74 and the kickback unit 76 to return to the registration roller pair 70 upstream of the transferring subsection 34, and second switching means 80 provided at the branch point between the kickback unit 76 and the return conveying path 78.

The first switching means 72 and the second switching means 80 are each known means for switching the sheet conveying path such as a flapper that acts on the conveying path (or is inserted in the conveying path) to guide the recording sheet A to a predetermined conveying path.

When a double-sided print is produced in the printer 10, the first switching means 72 is caused to act on the conveying path on the downstream side from the primary fixing roller pair 36 to convey the recording sheet A to the branching path 74, from which the recording sheet A is conveyed to the kickback unit 76. Then, when the upstream end of the recording sheet A has reached the downstream side of the second switching means 80, the conveyance is stopped.

Next, the second switching means 80 is caused to act on the kickback unit 76 to change the conveying direction at the kickback unit 76 and the recording sheet A is conveyed to the return conveying path 78 in a direction opposite to the above direction while guided by the second switching means 80 and is further conveyed from the return conveying path 78 to the registration roller pair 70. In this manner, the front surface and the rear surface of the recording sheet are reversed.

Explanation will be made for the case where the double-sided print is produced by using both of the primary fixing roller pair 36 (serving as a primary fixing subsection) and the second fixing subsection 38 in the printer 10 shown in FIG. 1. The reversing subsection 40 is branched at a position downstream of the primary fixing roller pair 36 as well as upstream of the secondary fixing subsection 38. Therefore, since the recording sheet A passes through the primary fixing roller pair 36 immediately after the toner image has been transferred, both of the double-sided images can be subjected to the fixing treatment. In the case where the recording sheet A having the images recorded on both surfaces passes through the secondary fixing subsection 38, the image is transferred after being reversed by the reversing subsection 40, and since one surface of the fixed recording sheet A becomes abutted against a fixing belt 88 (to be specific, heating roller 85) of the secondary fixing subsection 38 which will be described later, the surface is subjected to a surface treatment such as glossing treatment. However, since one surface of the recording sheet A onto which the image has been first transferred becomes a surface that is not abutted against the fixing belt 88, the surface cannot be subjected to the surface treatment by the fixing belt 88. Therefore, in this case, it is preferable to use a recording sheet of which only one surface is a photographic image quality print processing surface and the other surface is a plain paper as the recording sheet A. In this way, the recording sheet A whose only one surface is the photographic image quality print processing surface is used, and the recording sheet A is reversed once or twice, thereby making it possible for the photographic image quality print processing surface to be abutted against the fixing belt 88.

Accordingly, it is possible that the reversing subsection 40 is not branched from a position downstream of the primary fixing roller pair 36 (serving as the primary fixing subsection) as well as upstream of the secondary fixing subsection 38, but is branched from a position downstream of the secondary fixing subsection 38. With this structure, both surfaces of the recording sheet A can be abutted against the fixing belt 88 of the secondary fixing subsection 38, so, by using the recording sheet A having both surfaces being the photographic image quality print processing surface, it is possible to subject the both surfaces of the recording sheet A to the surface treatment such as the glossing treatment.

The intermediate conveying roller pair 37 is disposed downstream of the primary fixing roller pair 36 (corresponding to a position slightly upstream of a branching point to the reversing subsection 40 and the secondary fixing subsection 38). The intermediate conveying roller pair 37 constitutes an intermediate conveying subsection in the present invention, and conveys the recording sheet A that has been conveyed by the transferring subsection 34 and the primary fixing roller pair 36 to the downstream secondary fixing subsection 38.

In the illustrated example, there is disposed one intermediate conveying roller pair 37. However, it is needless to say that plural pairs of intermediate conveying rollers 37 may be disposed between the primary fixing roller pair 36 and the secondary fixing subsection 38 so that conveying that will be described later is appropriately conducted on the recording sheets A of any applicable length according to an interval between the primary fixing roller pair 36 and the secondary fixing subsection 38 or to the length of the corresponding recording sheet A.

Figure 2:
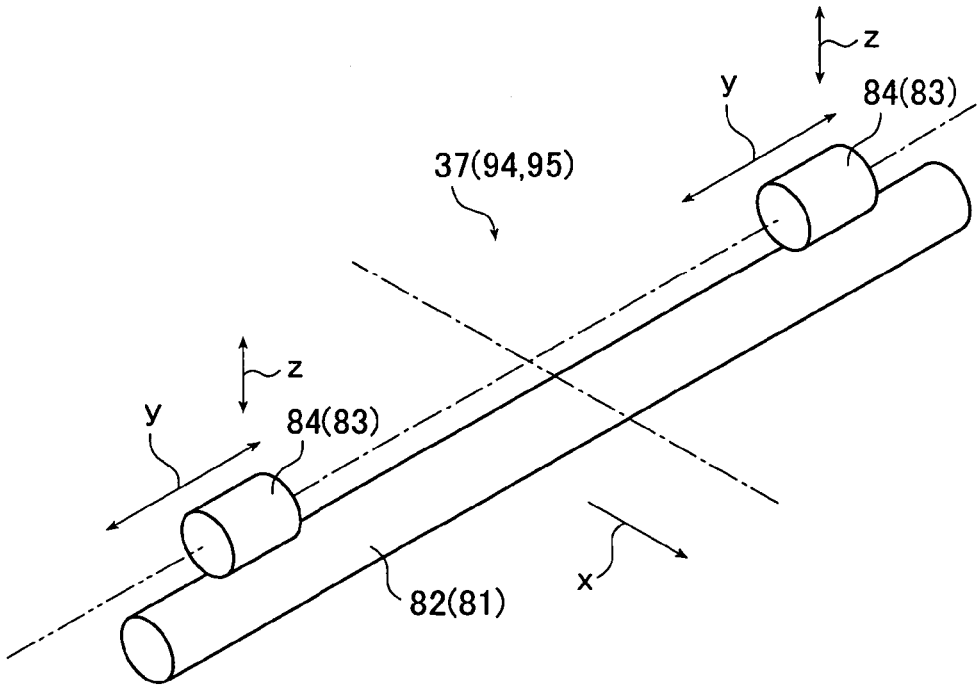
FIG. 2 is a perspective schematic view showing an embodiment of an intermediate conveying roller pair of the printer in FIG. 1.

As shown in FIG. 2, in the printer 10, the intermediate conveying roller pair 37 includes a longer roller 82 having a length in the axial direction that is longer than the maximum width of the recording sheet A, and two shorter rollers 84 that nip and convey the recording sheet A in association with the longer roller 82.

In the intermediate conveying roller pair 37, the longer roller 82 is a driving roller, and the shorter rollers 84 are driven rollers. Also, the longer roller 82 is disposed on the lower side (i.e., on non-image formation surface side), and the shorter rollers 84 are disposed on the upper side.

In the illustrated example, the position of the recording sheet A in the width direction is determined by a so-called center registration which makes the center of the recording sheet A in the width direction coincide with the center of the conveying path in the width direction.

The two shorter rollers 84 of the intermediate conveying roller pair 37 are apart from the center in the width direction indicated by a dashed line of FIG. 2 in the width direction (i.e., in FIG. 2, direction indicated by an arrow y, whereas an arrow x indicates a conveying direction) by the same distance, thereby allowing the interval to change. In the illustrated example, as a result, the intermediate conveying roller pair 37 copes with the recording sheets A of various widths.

Figure 3:
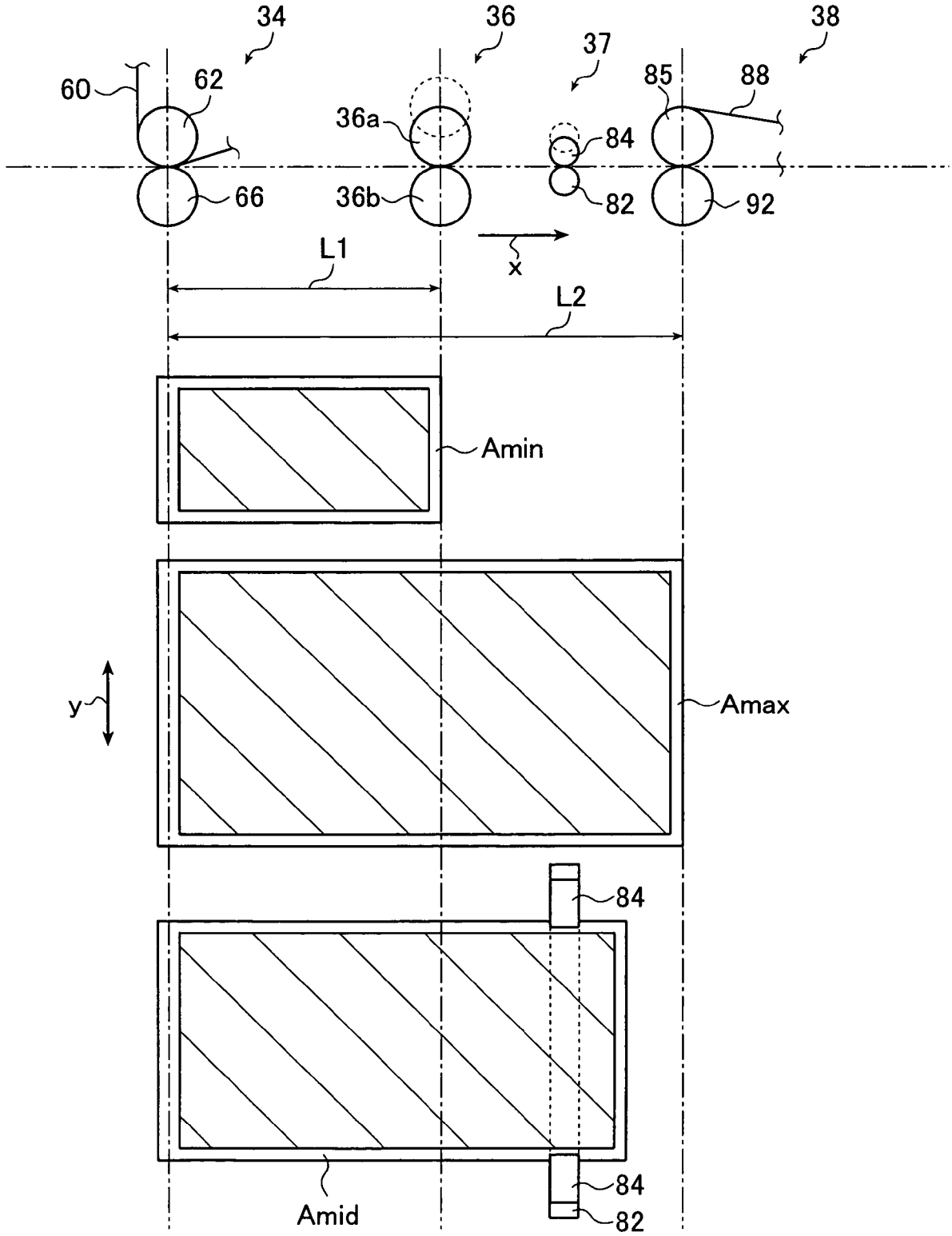
FIG. 3 is a conceptual diagram for explaining an example of an operation of a fixing process in the printer in FIG. 1.

In this example, as described above, in the printer 10, margins are produced at both sides of the recording sheet A on which the image has been recorded (i.e., transferred) before being cut. The intermediate conveying roller pair 37 adjusts the interval of the shorter rollers 84 according to the positional information (image recording positional information by the exposing unit 44) on the image on the recording sheet A in addition to the width information of the recording sheet A, and margins at the sides of the recording sheet A are nipped by the shorter rollers 84 and the longer roller 82 as shown in FIG. 3 that will be described later. As a result, the deterioration on the image that has been transferred onto the recording sheet A, and the contamination due to the unfixed toner are prevented.

In addition, the shorter rollers 84 can move up and down as indicated by an arrow z of FIG. 2 so as to be abutted against or apart from the longer roller 82. That is, the shorter rollers 84 and the longer roller 82 can be set in a nipping state and a release state.

In this example, as a preferred aspect of the printer 10 shown in the figure, the intermediate conveying roller pair 37 is capable of conducting both of the operation of moving the shorter rollers 84 downward from the release state at a dash and the operation of moving the shorter rollers 84 downward from the release state gradually, to change from the release state to the nipping state. This feature will be described later.

A method of making the interval of the two shorter rollers 84 narrower/wider with respect to the center of the width direction is not particularly limited, and various known methods are available. For example, there are available various known methods such as a method in which a shaft threaded is screwed into frames each pivotally supporting one of the shorter rollers 84 so that the frames move in an opposite direction with each other, a method in which frames each pivotally supporting one of the shorter rollers 84 are fixed on portions of a timing belt stretched around two pulleys so that the frames move in an opposite direction with each other, and the like.

Also, a method of making the shorter rollers 84 and the longer roller 82 in the release state and in the nipping state is not particularly limited. For example, there are known available various methods such as a method in which the two shorter rollers 84 capable of closing to or being apart from each other (or the two shorter rollers 84 and the frame that pivotably support the shorter rollers 84) are unified and held, and the unified shorter rollers 82 is pressed against the longer roller 82 side with a spring or the like and is moved up and down using a cam or the like.

In this embodiment, it is possible that the intermediate conveying section uses a belt conveyer instead of the longer roller 82, and the recording sheet A is nipped and conveyed by the belt conveyer and the shorter rollers 84.

The secondary fixing subsection 38 is disposed downstream of the intermediate conveying roller pair 37.

The secondary fixing subsection 38 includes a heating roller 85, a roller 86, a fixing belt 88 that is an endless belt stretched around the heating roller 85 and the roller 86, a cooling unit 90 that is wrapped by the fixing belt 88 and in contact with the fixing belt 88, and a nip roller 92 that nips the fixing belt 88 in association with the heating roller 85.

The heating roller 85 is a known heating roller that contains a heat source having a calorific power corresponding to the heat treatment of the recording sheet that will be described later. Also, the fixing belt 88 is a belt that is very high in smoothness of the surface (i.e., outer surface).

The secondary fixing subsection 38 subjects the recording sheet A to the surface treatment and the image fixing treatment due to heating and pressurization when producing the print with a high quality which has a gloss or the like corresponding to the silver halide photography with the use of the above-mentioned photo-like print sheet as the recording sheet A.

To be specific, the recording sheet A (i.e., photo-like print sheet) onto which the image (i.e., toner image) has been transferred in the transferring subsection 34 is nipped and conveyed by the fixing belt 88 (or to be specific, heating roller 85) and the nip roller 92 to heat and pressurize the recording sheet A. After that, the recording sheet A is cooled by the cooling unit 90. As a result, the thermoplastic resin on the surface of the recording sheet A, or toner in addition to the thermoplastic resin are first melted. Then, the melted thermoplastic resin, or the melted thermoplastic resin and toner are cooled and solidified so as to be fixed.

In this situation, the thermoplastic resin on the surface of the recording sheet A is melted, cooled, and solidified while being pressurized and conveyed, and the surface properties of the fixing belt 88 are transferred. In this case, the fixing belt 88 has a very high surface smoothness as described above. Because of this smoothness, the recording sheet A becomes a sheet having high surface smoothness and favorable glossiness, whereby a print whose quality is as high as that of a silver halide photographic print can be obtained from the recording sheet A.

In the illustrated printer 10, the heating and cooling conditions used in the secondary fixing subsection 38 may be made adjustable so that the glossiness or other properties to be imparted to the surface of the recording sheet A (print) can be adjusted.

Matting treatment or the like may be performed instead of the glossing treatment by selecting the surface properties of the surface treatment belt 88.

As described above, in the printer 10, the primary fixing roller pair 36 (serving as the primary fixing section) is disposed downstream of the transferring subsection 34 for transferring the image onto the recording sheet A, the secondary fixing subsection 38 is disposed downstream of the primary fixing roller pair 36, and the intermediate conveying roller pair 37 is disposed between the primary fixing roller pair 36 and the secondary fixing subsection 38.

In this case, an interval between the image transfer position at which the image is transferred to the recording sheet A in the transferring subsection 34 (that is, the abutment position (i.e., nipping position of the recording sheet A) of the endless belt 60 (to be specific, roller 62) against the transfer roller 66) and the primary fixing roller pair 36 (i.e., nipping position of the recording sheet A) is slightly shorter than the length of the corresponding recording sheet A having a minimum length. That is, the conveying distance of the recording sheet A from the image transfer position at which the image is transferred to the recording sheet A to the primary fixing roller pair 36 is slightly shorter than the length of the recording sheet A having a minimum length.

Also, an interval between the above-mentioned image transfer position and the secondary fixing subsection (that is, the abutment position (i.e., the nipping position of the recording sheet A) of the nip roller 92 and the fixing belt 88 (to be specific, heating roller 85) is slightly shorter than the length of the corresponding recording sheet A having a maximum length. That is, the conveying distance of the recording sheet A from the image transfer position at which the image is transferred to the recording sheet A to the secondary fixing subsection 38 is slightly shorter than the length of the recording sheet having a maximum length.

In addition, as described above, the recording sheet A onto which the image has been transferred in the transferring subsection 34 has margins at the forward and rear ends as well as both lateral sides thereof.

In the image forming apparatus according to the present invention, in the image forming process having the image transfer process and the fixing process, the above structure makes it possible to prevent the image quality from being deteriorated by banding and stably produce the high-quality print according to intended purposes that require the production of the high-quality print as in the photographic quality print production which uses the above-mentioned photo-like print sheet. Also, since the conveying distance between the image transfer position and the secondary fixing subsection is set according to the recording sheet A of the maximum length, the apparatus is prevented from being upsized.

Hereinafter, a description will be given of the operation of fixing the image that has been transferred to the recording sheet A in the printer 10 with reference to the conceptual diagram shown in FIG. 3. Simultaneously, the above structure and the image forming apparatus according to the present invention will be described in more detail.

First, in the case where an image is recorded onto a recording sheet $A_{min}$ that is a photo-like print sheet of the minimum length, both the primary fixing roller pair 36 and the intermediate conveying roller pair 37 are made in the nipping state, and the image on the recording sheet $A_{min}$ is fixed and conveyed.

The image is transferred onto the recording sheet $A_{min}$ by the transferring subsection 34, and the forward end of the recording sheet $A_{min}$ reaches the primary fixing roller 36.

In this case, as described above, a conveying distance L1 of the recording sheet A from the image transfer position at which the image is transferred to the recording sheet A to the primary fixing roller pair 36 is slightly shorter than the length of the recording sheet $A_{min}$ of the minimum length. In addition, a margin is provided at the rear end (and also, the forward end in the illustrated example) of the recording sheet A onto which the image has been transferred. Because of this, as schematically shown in FIG. 3, at the time when the forward end of the recording sheet $A_{min}$ having the minimum length is nipped by the primary fixing roller pair 36, the image (i.e., area indicated by oblique lines) has been completely transferred onto the recording sheet $A_{min}$ in the transferring subsection 34, and the margin at the rear end of the recording sheet $A_{min}$ is nipped by the transfer roller 66 and the transfer belt 60 (or roller 62) (in other words, the image is transferred to a position that realizes this state).

Therefore, the recording sheet $A_{min}$ can be appropriately conveyed to the primary fixing roller pair 36, and the forward end of the recording sheet $A_{min}$ enters between the primary fixing roller pair 36 and is nipped by the primary fixing roller pair 36. As a result, even if the load changes, no image unevenness due to banding occurs since the transfer has been completed at this time.

The recording sheet $A_{min}$ onto which the image has been fixed by the primary fixing roller pair 36 is subsequently nipped and conveyed by the intermediate conveying roller pair 37, and then conveyed to the secondary fixing subsection 38. The recording sheet $A_{min}$ that has been conveyed to the secondary fixing subsection 38 is nipped and conveyed by the fixing belt 88 (or heating roller 85) and the nip roller 92 as described above, with the result that the recording sheet $A_{min}$ is heated, pressurized, and cooled. The recording sheet $A_{min}$ is then subjected to the surface treatment and the secondary fixation. Then, the recording sheet $A_{min}$ is conveyed downstream.

In this state, it is preferable that the shorter rollers 84 of the intermediate conveying roller pair 37 be at positions, in the width direction, to nip the margins at the both sides according to the width information of the recording sheet A and the positional information of the image, but the present invention is not limited to this structure.

On the other hand, in the case where the image is recorded on a recording sheet $A_{max}$ that is the photo-like print sheet of the maximum length, both the primary fixing roller pair 36 and the intermediate conveying roller pair 37 are made in a separated (i.e., nipping release) state, and the image is transferred, as indicated by a dotted line of FIG. 3.

Accordingly, the recording sheet $A_{max}$ onto which the image has been transferred by the transferring subsection 34 passes through the primary fixing roller 36 and the intermediate conveying roller pair 37, and the forward end of the recording sheet $A_{max}$ reaches the secondary fixing subsection 38.

In this case, as described above, a conveying distance L2 of the recording sheet A from the image transfer position at which the image is transferred to the recording sheet A to the secondary fixing subsection 38 is slightly shorter than the length of the recording sheet $A_{max}$ of the maximum length. In addition, a margin is provided at the rear end (and also, the forward end in the illustrated example) of the recording sheet A onto which the image has been transferred. Because of this, as schematically shown in FIG. 3, at the time when the forward end of the recording sheet $A_{max}$ having the maximum length is nipped by the nip roller 92 of the secondary fixing subsection 38 and the fixing belt 88 (or heating roller 85) in the above example, the image has been completely transferred onto the recording sheet $A_{max}$ in the transferring subsection 34, and the margin at the rear end of the recording sheet $A_{max}$ is nipped by the transfer roller 66 and the transfer belt 60 (or roller 62) (in other words, the image is transferred to a position that realizes this state).

Therefore, the recording sheet $A_{max}$ can be appropriately conveyed to the secondary fixing subsection 38, and the forward end of the recording sheet $A_{max}$ enters the secondary fixing subsection 38 and is nipped by the secondary fixing subsection 38. As a result, even if the load changes, no image unevenness due to banding occurs since the transfer has been completed at this time.

That is, in the present invention, the conveying distance from the image transfer position to the primary fixing roller pair 36 is slightly shorter than the length of the recording sheet $A_{min}$ of the minimum length, and the conveying distance from the image transfer position to the secondary fixing subsection 38 is slightly shorter than the length of the recording sheet $A_{max}$ of the maximum length. Those structures indicate that the conveying distance is shorter than the length of the margin at the rear end of the recording sheet A (and the position at which the image is transferred onto the recording sheet A is so controlled as to realize this state).

The recording sheet $A_{max}$ that has been conveyed onto the secondary fixing subsection 38 is nipped and conveyed by the fixing belt 88 (or heating roller 85) and the nip roller 92 in the secondary fixing subsection 38 as described above. Then, the recording sheet $A_{max}$ is heated, pressurized, and cooled, i.e., subjected to the surface treatment and fixation to be conveyed downstream.

Alternatively, in recording the image on the recording sheet $A_{max}$ of the maximum length, it is possible that the shorter rollers 84 of the intermediate conveying roller pair 37 are positioned in the width direction at the margins of the sides of the recording sheet $A_{max}$ according to the width information of the recording sheet $A_{max}$ and the positional information of the image. Then, when the transfer has been completed in the transferring subsection 34, the shorter rollers 84 move down and the recording sheet $A_{max}$ is nipped and conveyed by the intermediate conveying roller pair 37.

Further, when the image is recorded on a recording sheet $A_{mid}$ that is a photo-like print sheet having a length which is longer than the recording sheet $A_{min}$ of the minimum length, and shorter than the recording sheet $A_{max}$ of the maximum length (hereinafter referred to as "middle length"), both the fixing roller pair 36 and the intermediate conveying roller pair 37 are left in a separated (i.e., nipping release) state as indicated by a dotted line in FIG. 3, likewise. Also, the shorter rollers 84 of the intermediate conveying roller pair 37 are located at the margins of the sides of the recording sheet $A_{max}$ in the width direction according to the width information of the recording sheet A and the positional information of the image.

The recording sheet $A_{mid}$ onto which the image has been transferred by the transferring subsection 34 in this state passes through the primary fixing roller 36, and the forward end of the recording sheet $A_{mid}$ reaches the intermediate conveying roller pair 37.

In this case, in recording the image on the recording sheet $A_{mid}$ of the middle length, three kinds of operation (i.e., modes) is exemplified as the operation of the intermediate conveying roller pair 37.

In a first mode, even if the forward end of the recording sheet $A_{mid}$ reaches the intermediate conveying roller pair 37, the intermediate conveying roller pair 37 does not nip the recording sheet $A_{mid}$. As with the recording sheet $A_{min}$ or the recording sheet $A_{max}$, when the image has been completely transferred in the transferring subsection 34 and the margin at the rear end of the recording sheet $A_{max}$ is nipped by the transfer roller 66 and the transfer belt 60 (or roller 62), the shorter rollers 84 move down to bring the intermediate conveying roller pair 37 into the nipping state, and the recording sheet $A_{mid}$ is conveyed by the intermediate conveying roller pair 37 as shown in the bottom portion of FIG. 3.

In this method, since the nipping by the intermediate conveying roller pair 37 is conducted after the image has been completely transferred, the image unevenness due to banding can be prevented from occurring.

In a second mode, the shorter rollers 84 of the intermediate conveying roller pair 37 gradually move down at a given timing into the nipping state after the forward end of the recording sheet $A_{mid}$ of the middle length has passed through the intermediate conveying roller pair 37 not depending on the completion of the transfer in the transferring subsection 34. Then, the recording sheet $A_{mid}$ is conveyed by the intermediate conveying roller pair 37.

Similarly, in this method, the recording sheet $A_{mid}$ is nipped after the forward end of the recording sheet $A_{mid}$ has passed through the intermediate conveying roller pair 37, and the shorter rollers 84 gradually move down to nip the recording sheet. As a result, the image unevenness can be prevented from occurring due to banding.

Figure 4:
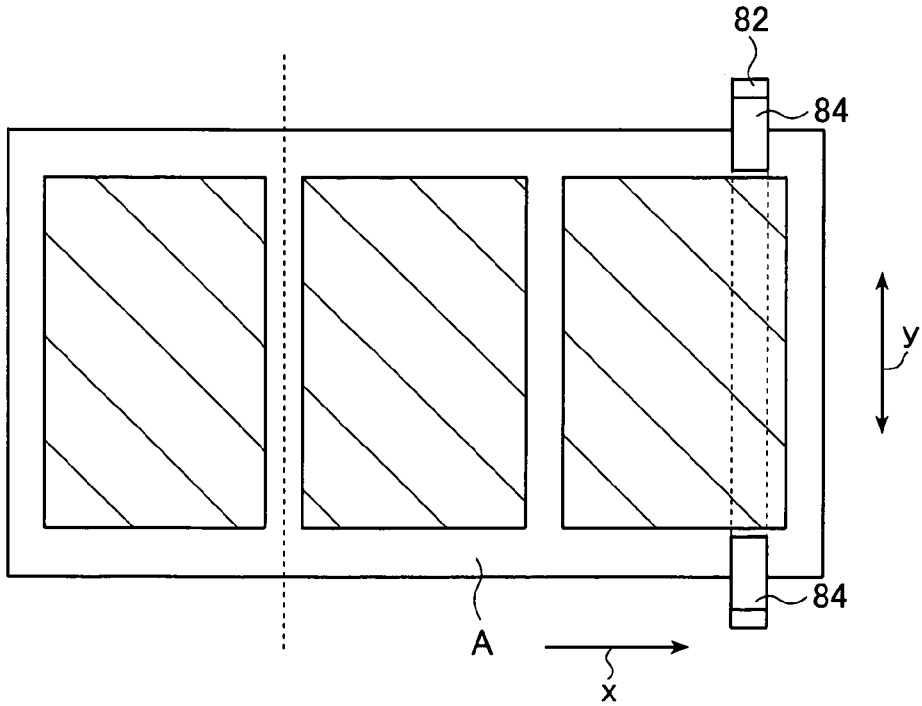
FIG. 4 is a conceptual diagram for explaining another example of the operation of the fixing process in the printer in FIG. 1.

A third mode is applied to a case in which plural images are imposed in the conveying direction (i.e., longitudinal direction) as shown in FIG. 4.

In this mode, the shorter rollers 84 move down and the intermediate conveying roller pair 37 is brought into the nipping state at the time when a portion between the images in the conveying direction comes to the image transfer position as indicated by a dotted line in FIG. 4 after the forward end of the recording sheet $A_{mid}$ of the middle length has reached the intermediate conveying roller pair 37. Then, the recording sheet $A_{mid}$ is conveyed by the intermediate conveying roller pair 37.

Similarly, in this method, since nipping by the intermediate conveying roller pair 37 is conducted during a state other than transferring, the image unevenness can be prevented from occurring due to banding. Also, since the interval between the images is finally cut by the cut/arrangement section 16, the product quality of the print is not deteriorated even if there is some kind of drawback generated between the images.

In the present invention, it is possible that only one of the first mode and the second mode is conducted, or any one of the first mode and the second mode can be selected when the image is recorded on the recording sheet $A_{mid}$ of the middle length.

In addition, it is possible that the third mode is not set, or the third mode is set and selectable in the case where the third mode can be implemented.

In the case where the image is recorded on the recording sheet $A_{mid}$ of the middle length with the second mode and the third mode, the recording sheet $A_{mid}$ is nipped and conveyed by the intermediate conveying roller pair 37 during the transfer of the image in the transferring subsection 34. Because of this, there is the possibility that the nipping and conveying of the recording sheet $A_{mid}$ by the intermediate conveying roller pair 37 gives a load change to the nipping and conveying by the transfer belt 60 and the transfer roller 66 in the transferring subsection 34, to thereby cause banding.

In order to prevent the above-mentioned drawback, it is preferable to prevent the intermediate conveying roller pair 37 from giving the load change to the transferring subsection 34 during transfer to more surely prevent the occurrence of banding through methods which includes a method of making the nipping force of the intermediate conveying roller pair 37 sufficiently weaker than the nipping force in the transferring subsection 34 (note that since the intermediate conveying roller pair 37 merely conveys the recording sheet A, the strong nipping force is unnecessary), a method of locating a one-way clutch that is capable of running idle only in the conveying direction on the longer roller 82 that is a driving roller of the intermediate conveying roller pair 37, and the like. Also, the above-mentioned structure makes it possible to reduce the load on the secondary fixing subsection 38 for conducting the surface treatment of the recording sheet A, and to prevent the quality of the surface of the recording sheet A which is caused by, for example, a slip between the recording sheet A and the fixing belt 88 from being deteriorated.

As described above, when the image is recorded on the recording sheet $A_{mid}$ of the middle length, it is possible that the cutout length of the recording sheet A in the supply section 12 is adjusted, or the image formation position in the recording sheet A is further adjusted so that the transferring subsection 34 nips the recording sheet A at the time when the forward end of the recording sheet A reaches the intermediate conveying roller pair 37 as occasion demands.

In the case where the image is formed on the plain paper that is not a photo-like print sheet as the recording sheet A, there are many cases in which high image quality is not required.

Accordingly, in this case, it is possible to conduct the primary fixation for fixing the toner image by the primary fixing roller pair 36 and the conveying by the intermediate conveying roller pair 37 after the completion of the image transfer in the transferring subsection 34 while both the primary fixing roller pair 36 and the intermediate conveying roller pair 37 are in the nipping state, not depending on the length of the recording sheet A. In the print production using the plain paper, since it is unnecessary to conduct the surface treatment that gives gloss or the like and the fixing treatment in the secondary fixing subsection 38, it is possible that the recording sheet A is made to pass through the secondary fixing subsection 38 without conducting any treatment such as heating by the heating roller 85 and cooling by the cooling unit 90. Alternatively, in the case where no cutting operation is required in the downstream cutting/arranging section 16, the recording sheet A may be outputted to a given tray as a print immediately after the fixation by the primary fixing roller pair 36 has been completed.

Even in the image formation on the plain paper, in the case where the high quality image is required, it is possible that all of the recording sheet $A_{max}$ of the maximum length, the recording sheet $A_{min}$ of the minimum length, and the recording sheet $A_{mid}$ of the middle length are subjected to fixing as with the above-mentioned photo-like print sheet.

As is apparent from the above description, in order to produce the print using the photo-like print sheet using the image forming apparatus according to the present invention, the primary fixing roller pair 36 is not always required. Also, it is possible that the fixation on the plain paper is conducted by the secondary fixing subsection 38.

However, it is preferable to conduct fixation as soon as possible after the image has been transferred onto the recording sheet A, taking the contamination of the surroundings due to toner, the facility of the conveying or handing of the recording sheet A, the stabilization of the image quality, and the like into consideration. In other words, in the present invention, the primary fixing roller pair 36 (serving as the primary fixing subsection) is provided, to thereby realize an improvement in convenience or stability in print production on the recording sheet A of the minimum length or the plain paper (i.e., a recording sheet that does not require the secondary fixation).

In the normal printer 10, the maximum length and the minimum length of the recording sheet A are not different depending upon the type of the recording sheet A. That is, normally, the maximum length and the minimum length of the plain paper and the photo-like print sheet are identical.

However, in the image forming apparatus according to the present invention, in the case where the maximum length and/or the minimum length is different depending on the type of the recording sheet A, it is preferable to set the conveying distance between the image transfer position and the primary fixing section and/or the secondary fixing section according to the minimum length and the maximum length of the recording sheet A of the type that requires the highest quality such as the photo-like print sheet in the printer 10.

In the illustrated example, as a preferred aspect for the purpose of preventing the contamination due to toner, margins are provided at all of four sides of the forward end, the rear end, and both lateral sides of the recording sheet A.

However, the present invention is not limited to the above-mentioned structure, but in the case where the image is recorded on the recording sheet A of the maximum length and the minimum length, no margin may be provided at the forward end and both sides of the recording sheet A (that is, the margin is provide at only the rear end). Also, in the case where the image is recorded on the recording sheet A of the middle length, no margin may be provided at the forward end (likely, the margins may be provided at only the rear end and the sides).

It is not always necessary to provide the margins between the respective images when multiple-image imposition is conducted depending on the nipping method and timing by the intermediate conveying roller pair 37.

Also, in the image forming apparatus according to the present invention, the image recording method is not limited to the electrophotograph shown in the illustrated example. There can be applied various image recording methods having a process of transferring an image onto a recording sheet (i.e., image receiving medium) and a fixing process after the transfer, such as image recording by separation transfer in which a latent image is recorded on a transfer sheet having a color material layer by heating or exposure, the latent image is transferred onto the recording sheet, and thereafter fixation is conducted.

The recording sheet A that has been processed in the secondary fixing subsection 38 is then conveyed to the cutting/arranging section 16.

The cutting/arranging section 16 includes a position adjusting subsection 100, a cutting subsection 102, an arranging subsection 104, and a discharging subsection 106.

The recording sheet A that has been conveyed to the cutting/arranging section 16 is first set to a given position in the width direction in the position adjusting subsection 100.

As described above, in the printer 10, one or more images are imposed on the recording sheet A in a state where the margins are provided in the periphery. In response to this, in the printer 10, the cutting subsection 102 that will be described later cuts the recording sheet A in the width direction and the conveying direction into an individual print according to the print size of the print to be produced. The position adjusting subsection 100 adjusts the position of the recording sheet A on which the image has been formed in the width direction to a given position in order to appropriately cut the recording sheet A.

There is no limit to the position adjusting means of the recording sheet A in the width direction in the position adjusting section 100, and various known position adjusting means for a sheet-like material can be used.

Examples of the position adjusting means include means that applies a method in which a guide plate is used to regulate the position of the recording sheet A in the width direction by contacting the side end of the recording sheet A thereto, a method in which a conveying roller pair having a position adjusting function in the axis direction is used to move the recording sheet A in the width direction while nipping it, and the like.

The recording sheet A whose position in the width direction has been adjusted by the position adjusting subsection 100 is then cut in the cutting subsection 102 according to the print size, whereby prints P (i.e. hard copies) to be outputted as products are obtained.

The cutting subsection 102 includes a first slitter 110, a second slitter 112, a guillotine cutter 114, and a registration roller pair 116.

Each of the first slitter 110 and the second slitter 112 is for cutting the recording sheet A in the conveying direction and is a known slitter using, for example, a rotary cutter or a circular cutter.

The first slitter 110 and the second slitter 112 each include two cutters which are arranged side by side in the width direction at the same position in the conveying direction. The two cutters are each adjustable in position in the width direction. The second slitter 112 is disposed downstream of the first slitter 110.

Each of the first slitter 110 and the second slitter 112 moves its respective cutters in the width direction in accordance with information about the width of the recording sheet A and information about the positions of images (i.e. information about the positions in the width direction), cuts the conveyed recording sheet A in the conveying direction, and cuts out the recording sheet A in the size of the print to be produced in the width direction.

The printer 10 records up to two images (i.e. performs imposition of up to two images) side by side in the width direction, for instance.

Figure 5B:
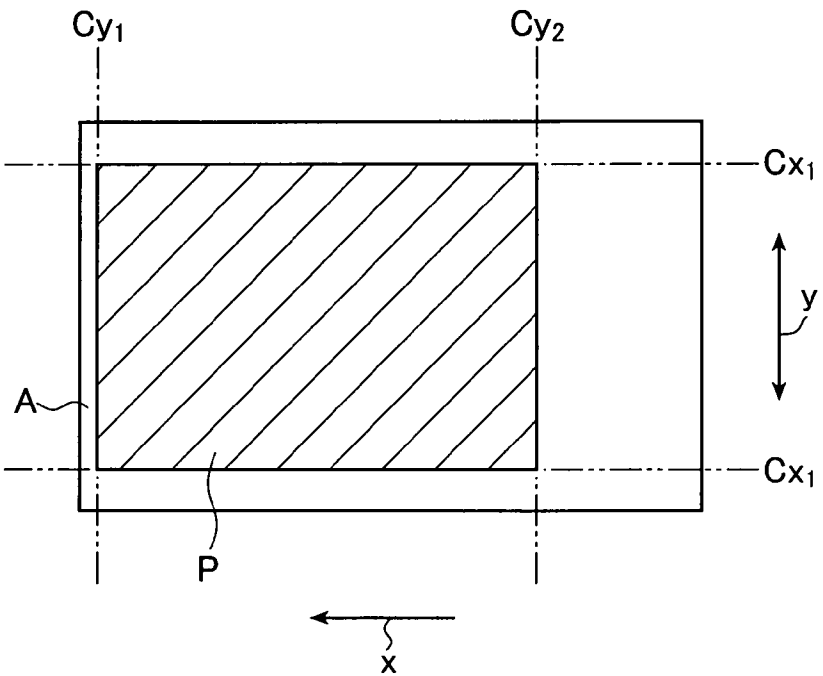
FIGS. 5A and 5B are conceptual diagrams showing an example of an image recording method in the printer in FIG. 1.
Figure 5A:
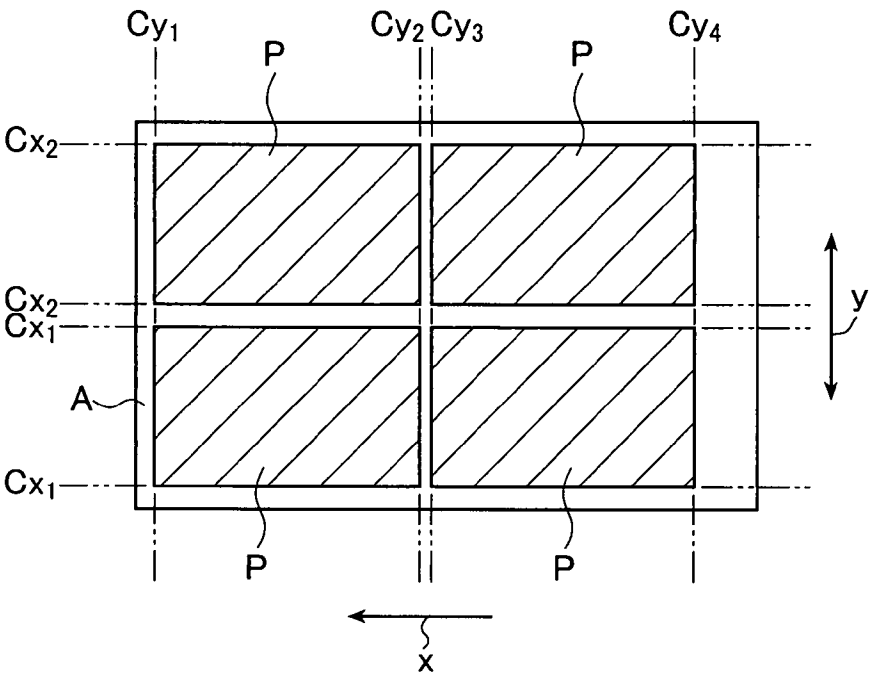

As shown in FIG. 5A, in the case of recording two images side by side in the width direction (indicated by an arrow "y"), the cutters of the first slitter 110 are arranged to correspond to one image in the width direction (e.g., an image on the left side when viewed from the upstream side to the downstream side in the conveying direction (indicated by an arrow "x")), and the recording sheet A is cut along cutting lines $Cx_1$ while being conveyed, whereby the images on the left side in the width direction can have a print size in the width direction. The cutters of the second slitter 112 on the downstream side are arranged to correspond to the other image (i.e., an image on the right side when viewed from the upstream side to the downstream side in the conveying direction), and the recording sheet A is cut along cutting lines $Cx_2$ while being conveyed, whereby the images on the right side in the width direction can have a print size in the width direction.

In other words, first, the images on the left side when viewed from the upstream side to the downstream side in the conveying direction are cut by the first slitter 110 in the conveying direction, and then the images on the right side when viewed from the upstream side to the downstream side in the conveying direction are cut by the second slitter 112 in the conveying direction.

On the other hand, when one image has been recorded in the width direction as shown in FIG. 5B, the second slitter 112 is retracted from the conveying path of the recording sheet A, the cutters of the first slitter 110 are arranged to correspond to the image recorded on the recording sheet A, and the recording sheet A is cut along cutting lines $Cx_1$ while being conveyed, whereby the image can have a size of a corresponding print in the width direction.

The guillotine cutter 114 is a known guillotine cutter with which the recoding sheet A is cut in the width direction.

The registration roller pair 116 is a conveying roller pair with which the conveyance of the recording sheet A is stopped at the position at which the recording sheet A is to be cut by the guillotine cutter 114 in accordance with the information about the image position on the recording sheet A (information about the position in the conveying direction), in other words, the cutting position in the conveying direction of the recording sheet A is determined.

For instance, in the case where two images have been recorded side by side in the conveying direction as shown in FIG. 5A, the registration roller pair 116 first stops the conveyance of the recording sheet A when a cutting line $Cy_1$ at the forward ends of images on the forward side of the sheet has reached the position at which the sheet is cut by the guillotine cutter 114. Next, the guillotine cutter 114 is actuated to cut the recording sheet A along the cutting line $Cy_1$.

After the cutting, the registration roller pair 116 resumes the conveyance of the recording sheet A and stops the conveyance of the recording sheet A when a cutting line $Cy_2$ at the rear ends of the forward images has reached the position at which the sheet is cut by the guillotine cutter 114. Next, as in the above, the guillotine cutter 114 is actuated to cut the recording sheet A along the cutting line $Cy_2$. The recording sheet A has been cut in advance by the first slitter 110 and the second slitter 112 of the cutting subsection 102 along the cutting lines $Cx_1$ and the cutting lines $Cx_2$, so two prints P on the forward side are cut out by the guillotine cutter 114.

Then, the same procedure is repeated. More specifically, after the cutting, the registration roller pair 116 resumes the conveyance of the recording sheet A and stops the conveyance when a cutting line $Cy_3$ at the forward ends of the following images in the conveying direction has reached the position at which the sheet is cut by the guillotine cutter 114, after which the guillotine cutter 114 cuts the recording sheet A along the cutting line $Cy_3$. Then, the registration roller pair 116 resumes the conveyance and stops the conveyance when a cutting line $Cy_4$ at the rear ends of the following images has reached the cutting position, after which the guillotine cutter 114 cuts the recording sheet A along the cutting line $Cy_4$.

As a result of the cutting operation along the cutting line $Cy_3$ and the cutting line $Cy_4$ as well as the cutting operation along the cutting lines $Cx_1$ and the cutting lines $Cx_2$, two prints P on the rear side are cut out as in the case of the two prints P on the forward side. Consequently, four prints P each of which corresponds to a print size and bears one of four images recorded on the recording sheet A are cut out.

On the other hand, in the case where one image has been recorded in the conveying direction as shown in FIG. 5B, the registration roller pair 116 stops the conveyance of the recording sheet A when a cutting line $Cy_1$ at the forward end of the image has reached the position at which the sheet is cut by the guillotine cutter 114. Then, the guillotine cutter 114 is actuated to cut the recording sheet A along the cutting line $Cy_1$.

After the cutting, the registration roller pair 116 resumes the conveyance of the recording sheet A and stops the conveyance of the recording sheet A when a cutting line $Cy_2$ at the rear end of the image has reached the position at which the sheet is cut by the guillotine cutter 114. Then, as in the above, the guillotine cutter 114 is actuated to cut the recording sheet A along the cutting line $Cy_2$. As described above, the recording sheet A has been cut in advance by the first slitter 110 of the cutting subsection 102 along the cutting lines $Cx_1$, so one print corresponding to a print size and bearing the image recorded on the recording sheet A is cut out as a result of the cutting operation with the guillotine cutter 114.

Each print P cut in the cutting subsection 102 (or cut out from the recording sheet A) is then conveyed to the arranging subsection 104 and is further conveyed from the arranging subsection 104 to the discharging subsection 106.

The arranging subsection 104 discharges prints P cut in the cutting subsection 102 to the discharging subsection 106. When two images have been recorded side by side in the width direction on the recording sheet A, the arranging subsection 104 unifies two lines of prints P that have been obtained in the width direction through cutting into one line (or the print lines are unified) and discharges the unified prints P to the discharging subsection 106. In the illustrated embodiment, the arranging subsection 104 includes an introducing roller unit 120, conveying roller pairs 122, 124, and 132, a discharging roller pair 126, and a line unifying roller pair 130.

The discharging subsection 106 is a belt conveyor including two rollers 140 and an endless belt 142 stretched around the rollers 140.

The introducing roller unit 120 of the arranging subsection 104 includes two roller pairs 120*a* and 120*b* that are arranged side by side in the width direction. The roller pairs 120*a* and 120*b* are each a pair of conveying rollers capable of being driven independently of each other.

In the case where two images have been recorded side by side in the width direction, the roller pair 120*a* that is one of the introducing roller unit 120 serves to convey each print P (or is disposed at the position in the width direction of the print P) obtained through cutting with the first slitter 110 along the cutting lines $Cx_1$; and the roller pair 120*b* that is the other of the introducing roller unit 120 serves to convey each print P (or is disposed at the position in the width direction of the print P) obtained through cutting with the second slitter 112 along the cutting lines $Cx_2$.

The arranging subsection 104 includes a lower first conveying path 134 which branches downstream of the introducing roller unit 120 and includes the conveying roller pairs 122 and 124, and an upper second conveying path 136 including the line unifying roller pair 130 and the conveying roller pair 132. The line unifying roller pair 130 of the second conveying path 136 is a conveying roller pair that is movable in the width direction.

The conveying path on which the roller pair 120*a* is provided corresponds to the first conveying path 134, and the conveying path on which the roller pair 120*b* is provided corresponds to the second conveying path 136. A guide member (not shown) which acts on the conveying path on which the roller pair 120*a* is provided and optionally the conveying path on which the roller pair 120*b* is provided to guide the prints P to the first conveying path 134 is disposed at the position at which the above conveying path branches out into the first and second conveying paths.

In addition, the conveying paths 134, 136 join downstream of the conveying roller pair 124 and the conveying roller pair 132 by means of a guide member (not shown) to reach the discharging roller pair 126.

When two images have been recorded side by side in the width direction as shown in FIG. 5A, the guide member is caused to act only on the conveying path on which the roller pair 120*a* of the introducing roller unit 120 is provided.

Two lines of the cut prints P disposed in the width direction are conveyed to the arranging subsection 104, where the prints P cut by the first slitter 110 are conveyed to the first conveying path 134 by the roller pair 120*a* and the guide member and the prints P cut by the second slitter 112 are conveyed to the second conveying path 136 by the roller pair 120*b*.

The prints P conveyed to the first conveying path 134 are supplied through the conveying roller pairs 122 and 124 to the discharging roller pair 126, from which the prints P are then discharged to the discharging subsection 106.

On the other hand, when the conveyed print P has been nipped between the line unifying roller pair 130 of the second conveying path 136 and is apart from the roller pair 120*b*, the conveyance is stopped (similarly, the roller pair 120*b* is also stopped) . Next, the line unifying roller pair 130 is moved in the width direction, thereby moving the print P to a position in the width direction corresponding to the roller pair 120*a*. After the movement in the width direction, the line unifying roller pair 130 and optionally the conveying roller pair 132 start conveying the print P in synchronization with the conveyance to the discharging roller pair 126 of the print P having been supplied to the first conveying path 134 so that each set of the prints P disposed side by side are sequentially conveyed to the discharging roller pair 126. Next, the discharging roller pair 126 discharges the print P to the discharging subsection 106.

In the example shown in FIG. 5A, two prints P have been formed side by side also in the conveying direction.

In this case, when the preceding print P has passed through the line unifying roller pair 130, the line unifying roller pair 130 is moved backward in the width direction to return to the original position. Next, the following print P is conveyed from the roller pair 120*b* to the second conveying path 136. As in the case described above, when the print P is nipped between the line unifying roller pair 130 and is apart from the roller pair 120*b*, the conveyance in the second conveying path 136 to which the print P has been conveyed is stopped. Next, the line unifying roller pair 130 is moved in the width direction, thereby moving the print P to the position in the width direction corresponding to the roller pair 120*a*. Then, the print P is conveyed by the line unifying roller pair 130 and the conveying roller pair 132 and then discharged to the discharging subsection 106 by the discharging roller pair 126.

As a result, two or more lines of prints P arranged in the width direction are unified into one line and then discharged to the discharging subsection 106.

In contrast to this, when one image has been recorded in the width direction as shown in FIG. 5B, the guide member is caused to act on both of the conveying path from the roller pair 120*a* and the conveying path from the roller pair 120*b*.

When the cut print P is conveyed to the arranging subsection 104, the introducing roller unit 120 whose roller pairs 120*a* and 120*b* are driven in synchronism, and the guide member convey the print P to the first conveying path 134, where the print P is conveyed through the conveying roller pairs 122 and 124 to the discharging roller pair 126 and is then discharged to the discharging subsection 106 through the discharging roller pair 126.

The discharging subsection 106 receives the prints P conveyed through and discharged/dropped from the discharging roller pair 126 and stacks the prints P on the belt conveyor. Then, when it is confirmed based on sort information that prints for one order have been stacked thereon, the discharging subsection 106 conveys the stack of the prints P by a predetermined distance set in accordance with the print size (maximum print length in the processed order) and stops the conveyance. Then, the discharging subsection 106 receives the prints P for the next order.

The image forming apparatus according to the first aspect of the present invention is basically structured as described above.

Subsequently, a description will be given of an image forming apparatus according to a second aspect of the present invention with reference to FIGS. 6 to 10.

Figure 6:
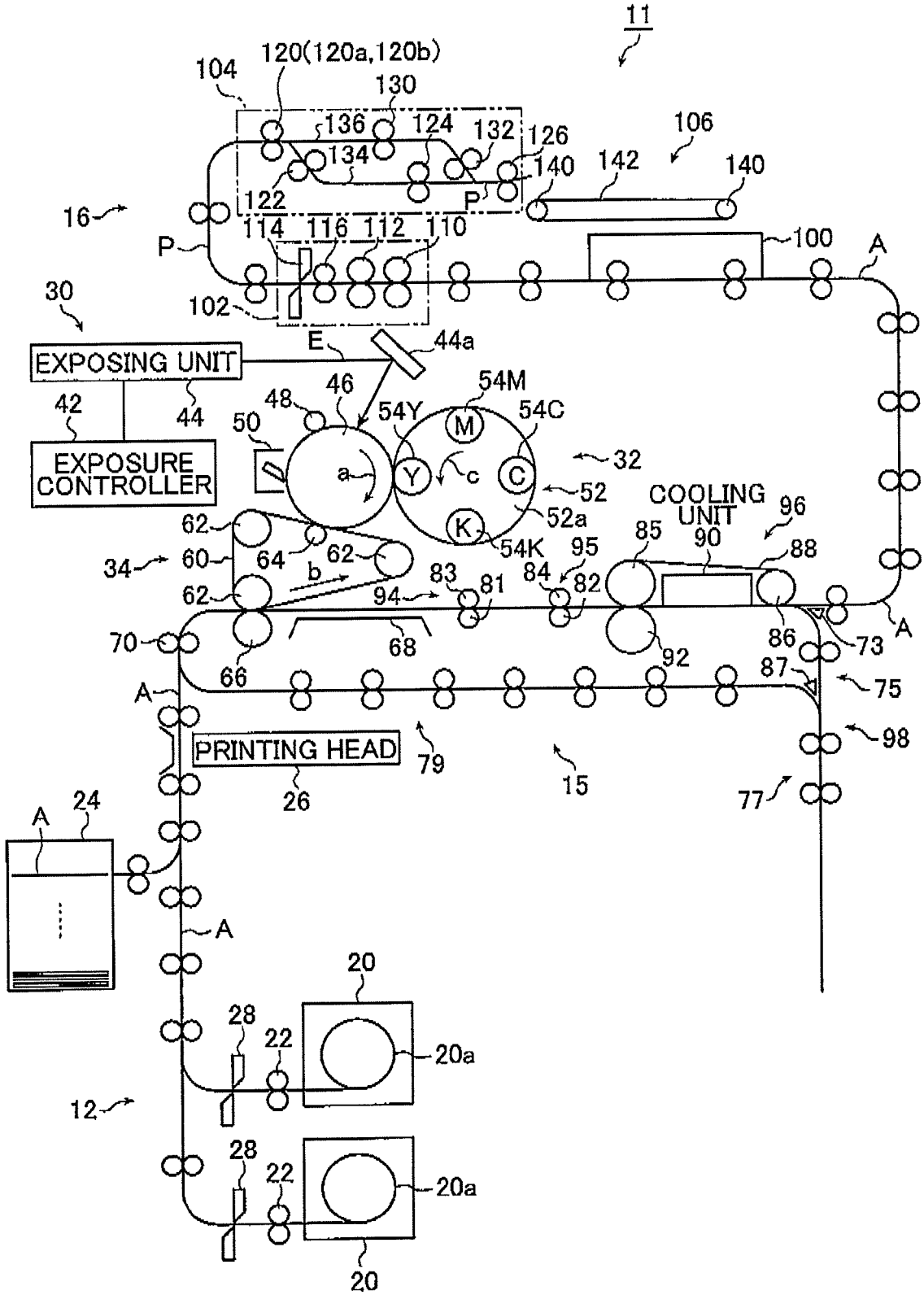
FIG. 6 is a conceptual diagram showing another embodiment of a printer using the image forming apparatus according to the present invention.

FIG. 6 shows a conceptual diagram of an embodiment of a printer using an image forming apparatus according to the second aspect of the present invention.

The printer 11 shown in FIG. 6 has the same structure as that of the printer 10 shown in FIG. 1 except that the image forming section 14 is replaced by an image formation section 15, and more particularly, that the image formation section 15 includes a first intermediate conveying roller pair 94, a second intermediate conveying roller pair 95, a fixing subsection 96, and a reversing subsection 98 instead of the primary fixing roller pair 36, the intermediate conveying roller pair 37, the secondary fixing subsection 38, and the reversing subsection 40 of the image forming section 14, respectively. Therefore, the same structures are denoted by identical numerals, and their detailed description will be omitted.

The printer 11 shown in FIG. 6, similar to the printer 10 in FIG. 1, basically records an image on the recording sheet A or image receiving medium by the electrophotographic system to produce a print. The printer 11 basically includes the recording sheet supplying section 12, the image formation section 15, and the cutting/arranging section 16.

The recording sheet supplying section 12 is a section for supplying the cut recording sheet A to the image formation section 15. For single side printing, the recording sheet A is supplied to the image formation section 15 after back printing is performed on the back surface (i.e., non-image recording surface) of the recording sheet A.

The image formation section 15 is a section where images are formed on the recording sheet A supplied from the recording sheet supplying section 12 by electrophotography and includes the exposing subsection 30, the toner image forming subsection 32, the transferring subsection 34, the first intermediate conveying roller pair (hereinafter referred to as a first conveying roller pair) 94, the second intermediate conveying roller pair (hereinafter referred to as a second conveying roller pair) 95, the fixing subsection 96, and the reversing subsection 98.

The image formation section 15 pertains to the image forming apparatus according to the second aspect of the present invention. In the image formation section 15, an interval (i.e., conveying distance) between a transfer position at which an image is transferred to the recording sheet A in the transferring subsection 34 and the first conveying roller pair 94 is slightly shorter than a minimum length of the recording sheet A applicable. In addition, an interval between the transfer position and the fixing subsection 96 is slightly shorter than a maximum length of the recording sheet A applicable. This feature will be described later.

The image formation section 15 shown in FIG. 6 includes the first conveying roller pair 94 that is identical in structure with the intermediate conveying roller pair 37 instead of the primary fixing roller pair 36 of the image forming section 14 shown in FIG. 1. For that reason, the pair of conveying rollers corresponding to the intermediate conveying roller pair 37 is the second conveying roller pair 95. Instead of the structure in which the toner image (image) is fixed by the primary fixing roller pair 36 and the surface treatment for glossing the image and the fixing treatment are conducted in the secondary fixing subsection 38, the image formation section 15 employs a structure in which the fixing treatment of the toner image (image) and the surface treatment for glossing the image are conducted by one fixing subsection 96 that is identical with the secondary fixing subsection 38 in structure, at the same time. Instead of the reversing subsection 40 that is branched from an upstream side of the secondary fixing subsection 38 and is converged to the upstream side of the transferring subsection 34, the image formation section 15 includes the reversing subsection 98 that is branched from the downstream side of the fixing subsection 96 and returns to the upstream side of the transferring subsection 34. The image formation section 15 is different from the image forming section 14 shown in FIG. 1 in the above structures, but other structures are identical with those in the image forming section 14 shown in FIG. 1, and therefore the differences will be mainly described.

The image has been formed on the recording sheet A in such a manner that an exposure is conducted by the exposing subsection 30, a toner image is formed by the toner image forming subsection 32, and the toner image is transferred onto the recording sheet (i.e., image receiving sheet) A as an image by the transferring subsection 34. The recording sheet A thus formed with the image is guided by the conveying guide 68, and then conveyed to the first conveying roller pair 94 and the second conveying roller pair 95.

The first conveying roller pair 94 and the second conveying roller pair 95 convey the recording sheet A on which the toner image has been formed by the transferring subsection 34 to the fixing subsection 96.

As shown in FIG. 2, in the printer 11, the first conveying roller pair 94 has the same structure as that of the intermediate conveying roller pair 37. The first conveying roller pair 94 includes a longer roller 81 having a length in the axial direction that is longer than the maximum width of the recording sheet A, and two shorter rollers 83 that nip and convey the recording sheet A in association with the longer roller 81.

In the first conveying roller pair 94, the longer roller 81 is a driving roller, and the shorter rollers 83 are driven rollers. Also, the longer roller 81 is disposed on the lower side (i.e., opposite side of the image transfer surface for double side printing, or non-image formation surface side for single side printing), and the shorter rollers 83 are disposed on the upper side.

As shown in FIG. 2, the first conveying roller pair 94, the longer roller 81, and the two shorter rollers 83 are identical in structure and function with the intermediate conveying roller pair 37, the longer roller 82, and the two shorter rollers 84, respectively.

The second conveying roller pair 95 is disposed downstream of the first conveying roller pair 94. The second conveying roller pair 95 conveys the recording sheet A that has been conveyed by the first conveying roller pair 94 to the downstream fixing subsection 96.

The second conveying roller pair 95 is completely identical in structure with the above-mentioned first conveying roller pair 94 (i.e., the intermediate conveying roller pair 37) including the longer roller 82 and the two shorter rollers 84 as shown in FIG. 2.

In the illustrated example, the intermediate conveying means that constitutes the intermediate conveying subsection includes two intermediate conveying roller pairs, that is, the first conveying roller pair 94 and the second conveying roller pair 95. However, three or more intermediate conveying roller pairs or only one intermediate conveying roller pair may be disposed between the transferring subsection 34 and the fixing subsection 96 so that conveying that will be described later is appropriately conducted on the recording sheet A of any applicable length according to the interval between the transferring subsection 34 and the fixing subsection 96, or the length of the corresponding recording sheet A.

In this aspect, it is possible that the longer rollers 81 and 82 are replaced by a belt conveyer as the intermediate conveying means, and the belt conveyer and the shorter rollers 83 and 84 nip and convey the recording sheet A.

The fixing subsection 96 is disposed downstream of the second conveying roller pair 95.

The fixing subsection 96 includes the heating roller 85, the roller 86, the fixing belt 88 that is an endless belt stretched around the heating roller 85 and the roller 86, and the cooling unit 90 that is wrapped by the fixing belt 88 and in contact with the fixing belt 88, and the nip roller 92 that nips the fixing belt 88 in association with the heating roller 85. As described above, the fixing subsection 96 of the image formation section 15 according to the second aspect conducts the fixing treatment of the toner image that has been transferred onto the recording sheet A, and the surface treatment such as a glossing treatment at the same time. On the contrary, the secondary fixing subsection 38 of the image forming section 14 according to the first aspect conducts the surface treatment (i.e., secondary fixing) such as the glossing treatment of the image on the recording sheet A which has been primarily fixed in the primary fixing section (i.e., the primary fixing roller pair 36). Thus, the fixing subsection 96 according to the second aspect is different from the secondary fixing subsection 38 according to the first aspect. However, since the fixing subsection 96 according to this embodiment is identical in structure with the secondary fixing subsection 38, the detailed description of the structure and similar functions will be omitted, and the different functions will mainly be described.

The fixing subsection 96 simultaneously conducts the surface treatment and the fixing treatment on the toner image that has been transferred onto the recording sheet A by heating and pressurization when producing the high-quality print having gloss or the like comparable to the silver halide photography with the use of the above-mentioned photo-like print sheet as the recording sheet A.

To be more specific, the recording sheet A (i.e., photo-like print sheet) onto which the image (i.e., toner image) has been transferred in the transferring subsection 34 is nipped and conveyed by the fixing belt 88 (or heating roller 85) and the nip roller 92 to heat and pressurize the recording sheet A. After that, the recording sheet A is cooled by the cooling unit 90. As a result, the thermoplastic resin on the surface of the recording sheet A, or the thermoplastic resin and the toner are first melted, and the melted thermoplastic resin or thermoplastic resin and toner are cooled, solidified, and fixed.

In this situation, the thermoplastic resin on the surface of the recording sheet A is melted, cooled, and solidified while being pressurized and conveyed together with the fixation, to thereby transfer the surface properties of the fixing belt 88. In this case, as described above, the fixing belt 88 has a very high surface smoothness. Because of this smoothness, the recording sheet A becomes a sheet having high surface smoothness and favorable glossiness, whereby a print whose quality is as high as that of a silver halide photographic print can be obtained from the recording sheet A.

In the illustrated printer 11, the heating and cooling conditions used in the fixing subsection 96 may be made adjustable so that the glossiness or other properties to be imparted to the surface of the recording sheet A (print) can be adjusted.

Matting treatment or the like may be performed instead of the glossing treatment by selecting the surface properties of the surface treatment belt 88.

As described above, in the printer 11, the first conveying roller pair 94 is disposed downstream of the transferring subsection 34 that transfers the image onto the recording sheet A, the second conveying roller pair 95 is disposed downstream of the first conveying roller pair 94, and the fixing subsection 96 is disposed downstream of the second conveying roller pair 95.

In the printer 11, an interval between the image transfer position at which the image is transferred to the recording sheet A in the transferring subsection 34 (that is, the abutment position (i.e., nipping position of the recording sheet A) between the endless belt 60 (or roller 62) and the transfer roller 66)) and the first conveying roller pair 94 (i.e., nipping position of the recording sheet A) is slightly shorter than the length of the corresponding recording sheet A having a minimum length. That is, the conveying distance of the recording sheet A from the image transfer position at which the image is transferred to the recording sheet A to the first conveying roller pair 94 is slightly shorter than the length of the recording sheet A of the minimum length.

Also, an interval between the image transfer position and the fixing subsection 96 (that is, the abutment position (i.e., the nipping position of the recording sheet A) between the nip roller 92 and the fixing belt 88 (or heating roller 85)) is slightly shorter than the length of the corresponding recording sheet A having a maximum length. That is, the conveying distance of the recording sheet A from the position at which the image is transferred to the recording sheet A to the fixing subsection 96 is slightly shorter than the length of the recording sheet A of the maximum length.

In addition, an interval between the first conveying roller pair 94 and the second conveying roller pair 95, and an interval between the second conveying roller pair 95 and the fixing subsection 96 (that is, the abutment position (i.e., the nipping position of the recording sheet A) of the nip roller 92 against the fixing belt 88 (or heating roller 85)) is shorter than the length of the recording sheet A of the minimum length.

Hereinafter, a description will be given of the operation of fixing the image that has been transferred to the recording sheet A in the printer 11 with reference to the conceptual diagrams shown in FIGS. 7 to 10. Simultaneously, the above structure and the image forming apparatus according to the present invention will be described in more detail.

First, in the case where an image is recorded onto a recording sheet $A_{min}$ of the minimum length, both the first conveying roller pair 94 and the second conveying roller pair 95 are made in the nipping state, and the image on the recording sheet $A_{min}$ is fixed and conveyed. Also, the shorter rollers 83 and 84 are positioned, in the width direction, so as to nip the margins at the side ends, according to the width information of the recording sheet A and the positional information of the image.

The image is transferred onto the recording sheet $A_{min}$ by the transferring subsection 34, and the forward end of the recording sheet $A_{min}$ reaches the first conveying roller pair 94.

Figure 7:
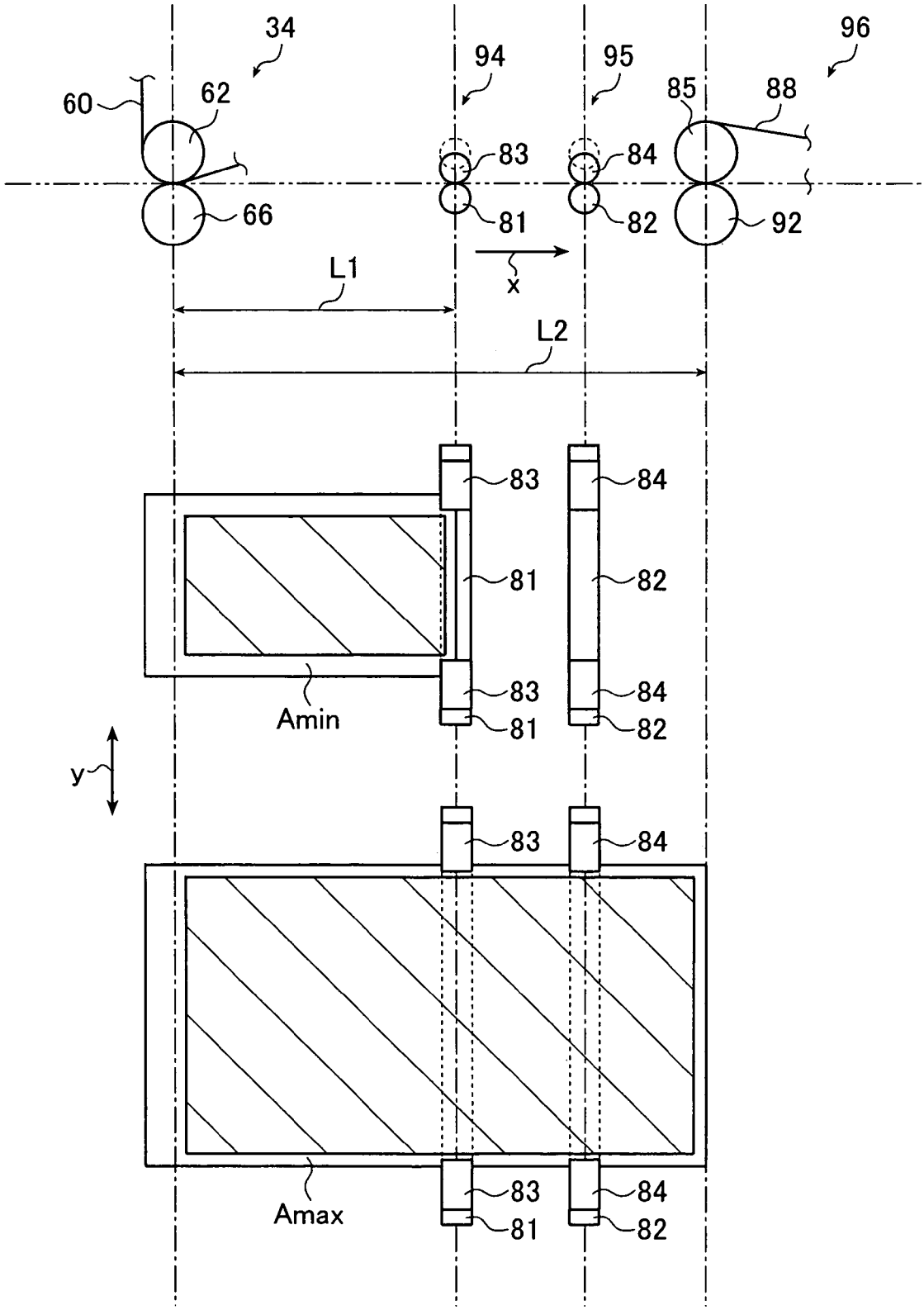
FIG. 7 is a conceptual diagram for explaining an example of the operation of the fixing process in the printer in FIG. 6.

In this case, as described above, a conveying distance L1 of the recording sheet A from the image transfer position at which the image is transferred to the recording sheet A to the first conveying roller pair 94 is slightly shorter than the length of the recording sheet $A_{min}$ of the minimum length. In addition, a margin is provided at the rear end (and also the forward end in the illustrated example) of the recording sheet A onto which the image has been transferred. For that reason, as schematically shown in FIG. 7, at the time when the forward end of the recording sheet $A_{min}$ having the minimum length is nipped by the first conveying roller pair 94, the image (i.e., area indicated by oblique lines) has been completely transferred onto the recording sheet $A_{min}$ in the transferring subsection 34, and the margin at the rear end of the recording sheet $A_{min}$ is nipped by the transfer roller 66 and the transfer belt 60 (or rollers 62) (in other words, the image is transferred to a position that realizes this state).

Therefore, the recording sheet $A_{min}$ can be appropriately conveyed to the first conveying roller pair 94, and the forward end of the recording sheet $A_{min}$ enters between the first conveying roller pair 94 and is nipped by the first conveying roller pair 94. As a result, even if the load change occurs, no image unevenness that is caused due to banding occurs since the transfer has been completed at this time. Also, since the shorter rollers 83 nip the margins at the side ends of the recording sheet $A_{min}$, the unfixed toner image is not adversely affected, and the shorter rollers 83 per se are not contaminated.

The recording sheet $A_{min}$ onto which the image has been fixed by the first conveying roller pair 94 is subsequently nipped and conveyed by the second conveying roller pair 95, and then conveyed to the fixing subsection 96. In this situation, since the shorter rollers 84 nip the margins at the side ends of the recording sheet $A_{min}$, the unfixed toner image is not adversely affected, and the shorter rollers 84 per se are not contaminated.

The second conveying roller pair 95 can be driven independently of the first conveying roller pair 94. Therefore, it is possible that the second conveying roller pair 95 is initially brought into the separated (i.e., nipping release) state, and then made in the nipping state at an arbitrary timing after the forward end of the recording sheet Ain is nipped by the first conveying roller pair 94.

The recording sheet $A_{min}$ that has been conveyed to the fixing subsection 96 is nipped and conveyed by the fixing belt 88 (or heating roller 85) and the nip roller 92 as described above, and as a result, the recording sheet $A_{min}$ is heated, pressurized, and cooled, i.e., subjected to the surface treatment and the fixation to be conveyed downstream.

On the other hand, in the case where the image is recorded on the recording sheet $A_{max}$ of the maximum length, both the first conveying roller pair 94 and the second conveying roller pair 95 are made in a separated (i.e., nipping release) state, and the image is transferred, as indicated by a dotted line in FIG. 7.

Therefore, the recording sheet $A_{max}$ onto which the image has been transferred by the transferring subsection 34 passes through the first conveying roller pair 94 and the second conveying roller pair 95, and the forward end of the recording sheet $A_{max}$ reaches the fixing subsection 96.

In this example, as described above, a conveying distance L2 of the recording sheet A from the image transfer position at which the image is transferred to the recording sheet A to the fixing subsection 96 is slightly shorter than the length of the recording sheet $A_{max}$ of the maximum length. In addition, a margin is provided at the rear end (and also the forward end in the illustrated example) of the recording sheet A onto which the image has been transferred. For that reason, as schematically shown in FIG. 7, at the time when the forward end of the recording sheet $A_{max}$ having the maximum length is nipped by the nip roller 92 of the fixing subsection 96 and the fixing belt 88 (or heating roller 85) as in the above example, the image has been completely transferred onto the recording sheet $A_{max}$ in the transferring subsection 34, and the margin at the rear end of the recording sheet $A_{max}$ is nipped by the transfer roller 66 and the transfer belt 60 (or rollers 62) (in other words, the image is transferred at a position that realizes this state).

Therefore, the recording sheet $A_{max}$ can be appropriately conveyed to the fixing subsection 96, and the forward end of the recording sheet $A_{max}$ enters the fixing subsection 96 and is nipped by the fixing subsection 96. As a result, even if the load changes, no image unevenness that is caused due to banding occurs since the transfer has been completed at this time.

That is, in the present invention, the conveying distance from the image transfer position to the first conveying roller pair 94 is slightly shorter than the length of the recording sheet $A_{min}$ of the minimum length, and the conveying distance from the image transfer position to the secondary fixing subsection 38 is slightly shorter than the length of the recording sheet $A_{max}$ of the maximum length. This means that the conveying distance is shorter than the recording sheet A by a length shorter than the margin at the rear end of the recording sheet A (i.e., the position at which the image is transferred onto the recording sheet A is so controlled as to realize this state).

The recording sheet $A_{max}$ that has been conveyed onto the fixing subsection 96 is nipped and conveyed by the fixing belt 88 (or heating roller 85) and the nip roller 92 in the fixing subsection 96 as described above. Then, the recording sheet $A_{max}$ is heated, pressurized, and is cooled, i.e., subjected to the surface treatment and fixation to be conveyed downstream.

Alternatively, in recording the image on the recording sheet $A_{max}$ of the maximum length, it is possible that the position of the shorter rollers 83 of the first conveying roller pair 94 in the width direction and the position of the shorter rollers 84 of the second conveying roller pair 95 in the width direction are at the margins of the side ends of the recording sheet $A_{max}$ according to the width information of the recording sheet A and the positional information of the image. Then, when the transfer has been completed in the transferring subsection 34, the shorter rollers 83 and 84 move down, and the recording sheet $A_{max}$ is nipped and conveyed by the first conveying roller pair 94 and the second conveying roller pair 95.

Further, when the image is recorded on a recording sheet $A_{mid}$ that is longer than the recording sheet $A_{min}$ of the minimum length and shorter than the recording sheet $A_{max}$ of the maximum length (hereinafter referred to as the middle length), both the first conveying roller pair 94 and the second conveying roller pair 95 are left in a separated (i.e., nipping release) state as indicated by a dotted line in FIGS. 8 and 9. Also, the positions of the shorter rollers 83 of the first conveying roller pair 94 in the width direction and the positions of the shorter rollers 84 of the second conveying roller pair 95 in the width direction are located at the margins of the side ends of the recording sheet $A_{mid}$, according to the width information of the recording sheet A and the positional information of the image.

The forward end of the recording sheet $A_{mid}$ onto which the image has been transferred by the transferring subsection 34 in this state reaches the first conveying roller pair 94, and thereafter reaches the second conveying roller pair 95.

In this case, in recording the image on the recording sheet $A_{mid}$ of the middle length, three kinds of operation (i.e., modes) is exemplified as the operation of the first conveying roller pair 94 and the second conveying roller pair 95.

Figure 8:
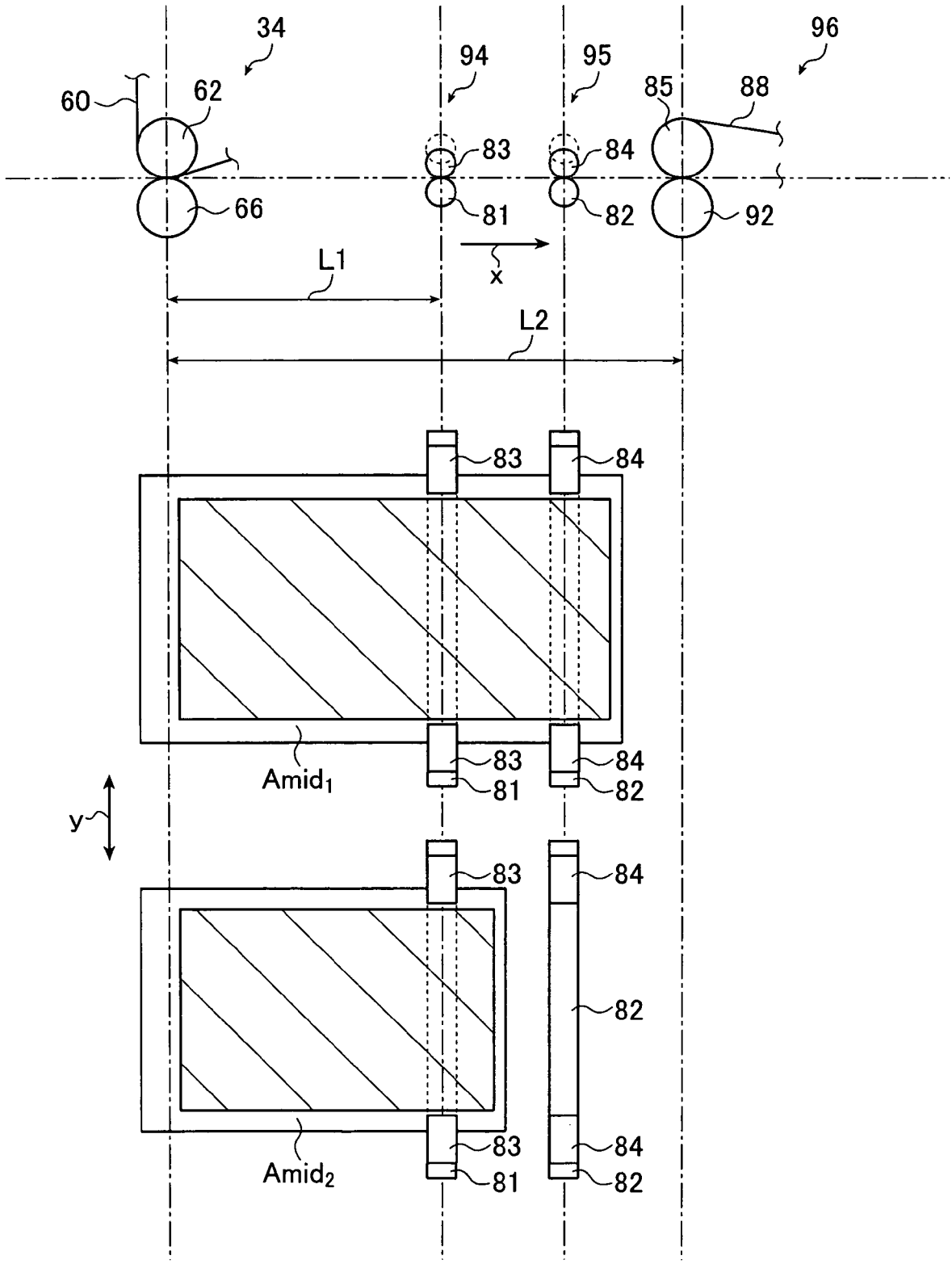
FIG. 8 is a conceptual diagram for explaining another example of the operation of the fixing process in the printer in FIG. 6.

In a first mode, even if the forward end of the recording sheet $A_{mid1}$ shown in FIG. 8 reaches the first conveying roller pair 94, the first conveying roller 94 does not nip the recording sheet $A_{mid1}$. As with the recording sheet $A_{min}$ or the recording sheet $A_{max}$, when the image has been completely transferred in the transferring subsection 34 and the margin at the rear end of the recording sheet $A_{mid1}$ is nipped by the transfer roller 66 and the transfer belt 60 (or the roller 62), the shorter rollers 83 and 84 move down to bring the first conveying roller pair 94 and the second conveying roller pair 95 into the nipping state, and the recording sheet $A_{mid1}$ is conveyed.

In this situation, it is possible that the second conveying roller pair 95 is brought into the nipping state at a timing different from that of the first conveying roller pair 94. For example, in a case of a recording sheet $A_{mid2}$ of the middle length shown in FIG. 8, when the forward end of the recording sheet has not reached the second conveying roller pair 95, the second conveying roller pair 95 can be brought into the nipping state after the forward end of the recording sheet $A_{mid2}$ has passed through the second conveying roller pair 95 and reached a given position, which is a timing different from the first conveying roller pair 94.

In this method, since the nipping by the first conveying roller pair 94 and the second conveying roller pair 95 is conducted after the image has been completely transferred, the image unevenness can be prevented from occurring due to banding. Also, since the shorter rollers 83 and 84 nip the margins at the side ends of the recording sheet $A_{mid2}$, the unfixed toner image is not adversely affected, and the shorter rollers 83 and 84 per se are not contaminated.

Figure 9:
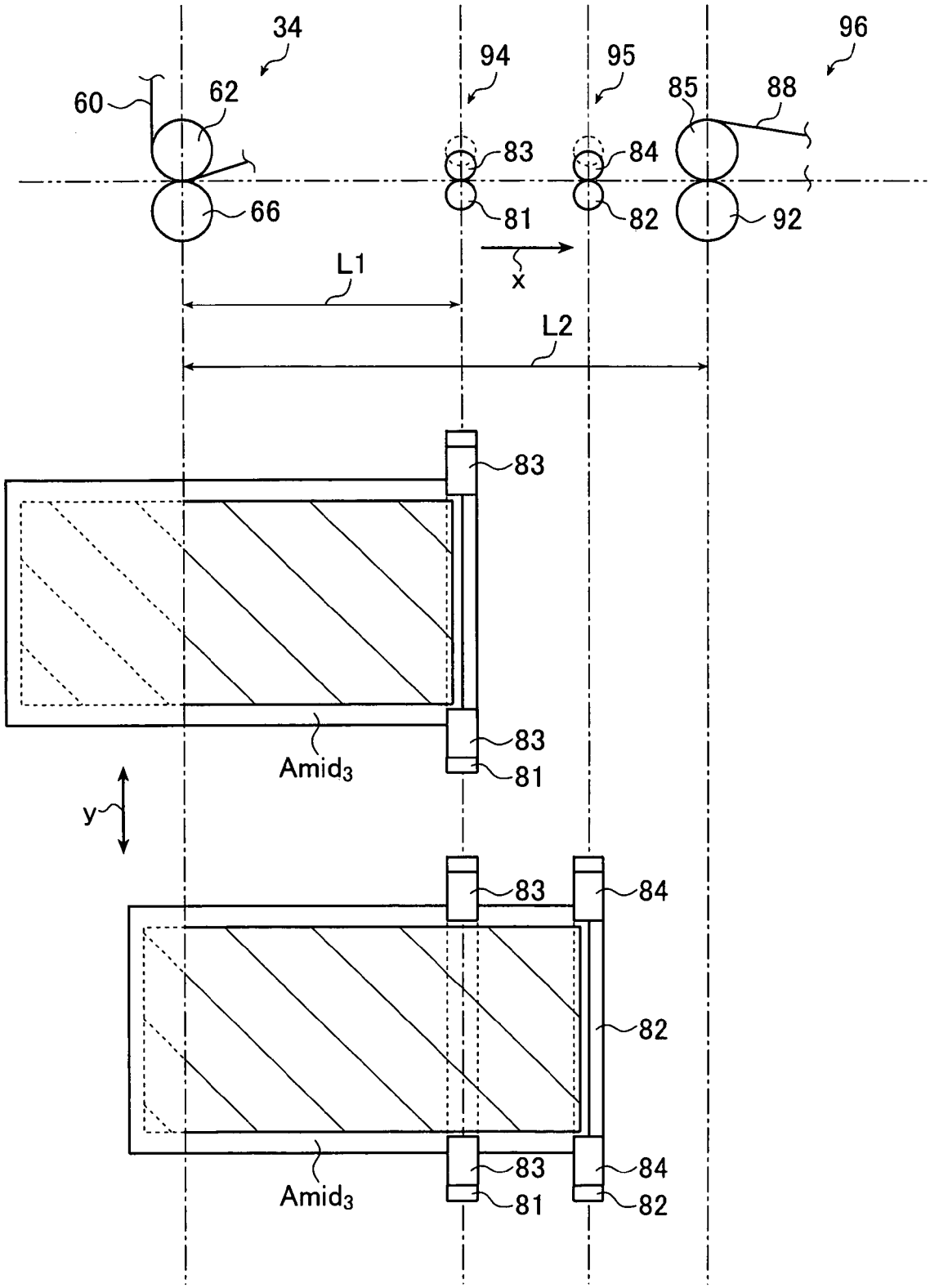
FIG. 9 is a conceptual diagram for explaining further another example of the operation of the fixing process in the printer in FIG. 6.

In a second mode, as shown in FIG. 9, the shorter rollers 83 of the first conveying roller pair 94 gradually move down at a given timing into the nipping state after the forward end of a recording sheet $A_{mid3}$ of the middle length has passed through the first conveying roller pair 94 not depending on the completion of the transfer of the image in the transferring subsection 34. Then, the recording sheet $A_{mid3}$ is conveyed by the first conveying roller pair 94. Further, the shorter rollers 84 of the second conveying roller pair 95 gradually moves down at a given timing into the nipping state to convey the recording sheet $A_{mid3}$ as with the first conveying roller pair 94 after the forward end of a recording sheet $A_{mid3}$ has passed through the second conveying roller pair 95.

Similarly, in this method, the recording sheet $A_{mid3}$ is nipped by the first conveying roller pair 94 and by the second conveying roller pair 95 after the forward end of the recording sheet $A_{mid3}$ has passed through the first conveying roller pair 94 and the second conveying roller pair 95, respectively, and the shorter rollers 83 and 84 gradually move down to nip the recording sheet. As a result, the image unevenness can be prevented from occurring due to banding. Also, since the shorter rollers 83 and 84 nip the margins at the side ends of the recording sheet $A_{mid3}$, the unfixed toner image is not adversely affected, and the shorter rollers 83 and 94 per se are not contaminated.

Also, in the case where the transfer of the image by the transferring subsection 34 is completed before the forward end of the recording sheet $A_{mid3}$ reaches the second conveying roller pair 95, the shorter rollers 84 of the second conveying roller pair 95 may be brought into the nipping state at any timing.

Figure 10:
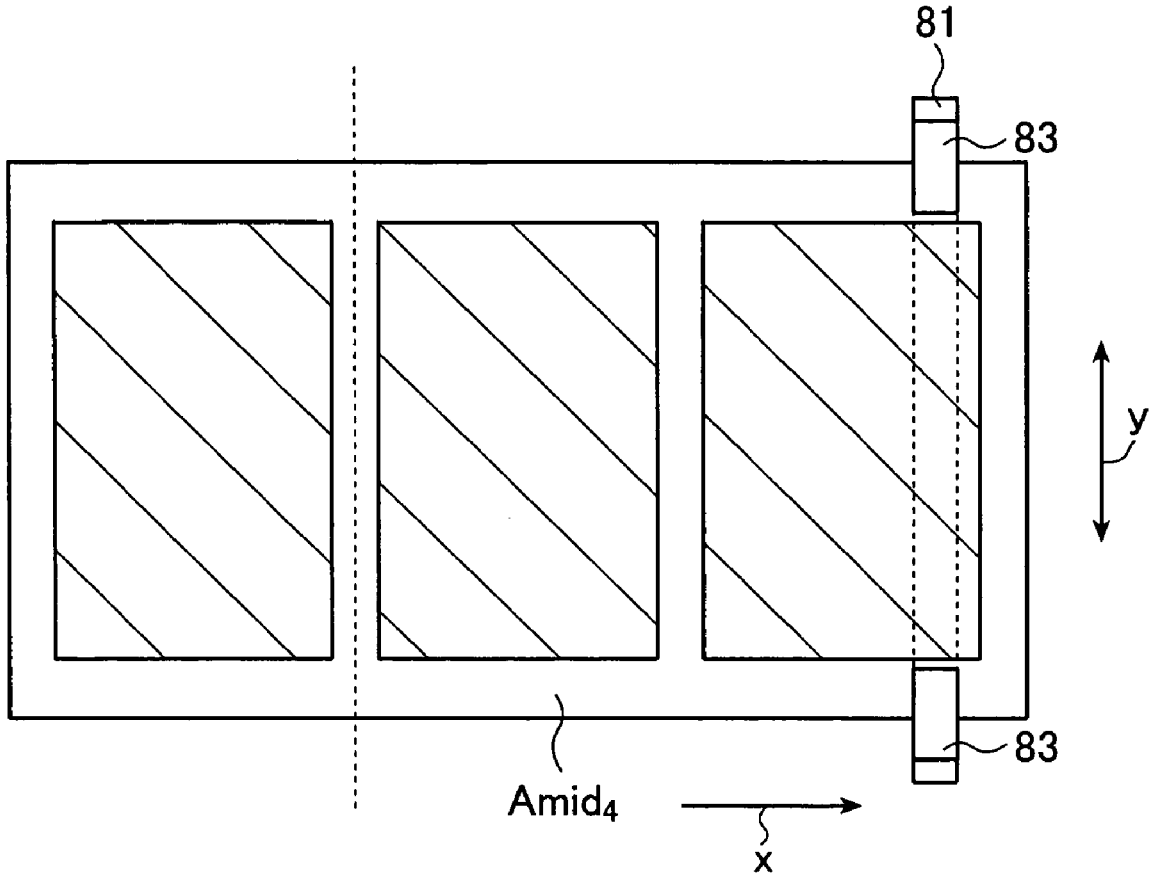
FIG. 10 is a conceptual diagram for explaining yet still further example of the operation of the fixing process in the printer in FIG. 6.

A third mode is applied to a case in which plural images are imposed in the conveying direction (i.e., longitudinal direction) as shown in FIG. 10.

In this mode, the shorter rollers 83 move down and the first conveying roller pair 94 is brought into the nipping state at the time when a portion between the images in the conveying direction comes to the image transfer position as indicated by a dotted line in FIG. 10 after the forward end of a recording sheet $A_{mid4}$ of the middle length has reached the first conveying roller pair 94, and the recording sheet $A_{mid3}$ is conveyed by the first conveying roller pair 94. Also, in the second conveying roller pair 95 as with the first conveying roller pair 94, the shorter rollers 84 move down, and the second conveying roller pair 95 is brought into the nipping state at the time when a portion between the images in the conveying direction comes to the image transfer position after the forward end of the recording sheet $A_{mid4}$ has reached the second conveying roller pair 95, and the recording sheet $A_{mid4}$ is conveyed by the second conveying roller pair 95.

Also, in the case where the transfer has been already completed in the transferring subsection 34 before the forward end of the recording sheet $A_{mid4}$ reaches the second conveying roller pair 95 as in the second mode, the shorter rollers 84 of the second conveying roller pair 95 can be brought into the nipping state at any timing.

Similarly, in this method, since nipping by the first conveying roller pair 94 and the second conveying roller pair 95 is conducted during a state other than transferring, the image unevenness can be prevented from occurring due to banding. Also, since the portion between the images is finally cut and removed by the cut/arrangement section 16, the product quality of the print is not adversely affected even if there is some kind of drawback between the images. Further, since the shorter rollers 83 and 84 nip the margins at the side ends of the recording sheet $A_{mid4}$, the unfixed toner image is not adversely affected, and the shorter rollers 83 and 84 per se are not contaminated.

In the present invention, it is possible that only one of the first mode and the second mode is conducted, or any one of the first mode and the second mode can be selected when the image is recorded on the recording sheet $A_{mid}$ of the middle length.

In addition, it is possible that the third mode is not set, or the third mode is set and made selectable in the case where The reversing subsection 98 is provided by branching the conveying path from the downstream of the fixing subsection 96.

The reversing subsection 98 is a subsection in which the recording sheet A having one surface recorded with the image is reversed to produce so-called double-sided prints. The reversing subsection 98 includes first switching means 73 disposed downstream of the fixing subsection 96, a path 75 branching from the conveying path from the fixing subsection 96, a kickback unit 77 provided downstream of the branching path 75, a return conveying path 79 that branches from the branching path 75 and the kickback unit 77 to return to the registration roller pair 70 upstream of the transferring subsection 34, and second switching means 87 provided at the branch point between the kickback unit 77 and the return conveying path 79. The first switching means 73, the branching path 75, the kickback unit 77, and the second switching means 87 in the reversing subsection 98 are disposed downstream of the fixing subsection 96, which are different, respectively, from the first switching means 72, the branching path 74, the kickback unit 76, and the second switching means 87 in the reversing subsection 40 shown in FIG. 1. Also, the return conveying path 79 of the reversing subsection 98 is longer than the return conveying path 78 of the reversing subsection 40. Other structures are identical with those in the reversing subsection 40.

The first switching means 73 and the second switching means 87 are each known means for switching the sheet conveying path such as a flapper that acts on the conveying path (or is inserted in the conveying path) to guide the recording sheet A to a predetermined conveying path.

When a double-sided print is produced in the printer 11, the first switching means 73 is caused to act on the conveying path from the fixing subsection 96 to convey the recording sheet A to the branching path 75, from which the recording sheet A is conveyed to the kickback unit 77. Then, when the upstream end of the recording sheet A has reached the downstream side of the second switching means 87, the conveyance is stopped.

Next, the second switching means 87 is caused to act on the kickback unit 77 to change the conveying direction at the kickback unit 77 and the recording sheet A is conveyed to the return conveying path 79 in a direction opposite to the above direction while guided by the second switching means 87 and is further conveyed from the return conveying path 79 to the registration roller pair 70. In this manner, the front surface and the rear surface of the recording sheet are reversed.

The cutting/arranging section 16 is disposed downstream of the reversing subsection 98. The recording sheet A that has been completely subjected to the fixing treatment and the surface treatment in the fixing subsection 96 is then conveyed to the cutting/arranging section 16.

The cutting/arranging section 16 includes the position adjusting subsection 100, the cutting subsection 102, the arranging subsection 104, and the discharging subsection 106.

The cutout process of the plural prints P from the recording sheet A in the cutting/arranging section 16 of the printer 11 shown in FIG. 6, the process of unifying the plural cutout prints P into a line, and the stacking process of the prints P unified into a line are conducted in the same manner as that of the cutout process, the unifying process, and the stacking process of the prints P in the cutting/arranging section 16 of the printer 10 shown in FIG. 1.

Various embodiments of the image forming apparatus according to the present invention were described above in detail. However, the present invention is not limited to those embodiments, and it is needless to say that various improvements and modifications may be conducted without departing from the scope of the present invention.

What is claimed is:

1. An image forming apparatus, comprising:

a transferring section that transfers an image to an image receiving medium at a given transfer position;

a primary fixing section that is disposed downstream of the transferring section, and is capable of bringing the transferred image into a fixing state where the image is fixed by pressurizing the image receiving medium, and into a non-fixing state; and a secondary fixing section that is disposed downstream of the primary fixing section, for fixing the transferred image by pressurizing the image receiving medium, wherein a conveying length of the image receiving medium from the transfer position to an image fixing position in the secondary fixing section is shorter than the length of the image receiving medium having a maximum length in the conveying direction, and a conveying length of the image receiving medium from the transfer position to a fixing position in the primary fixing section is shorter than the length of the image receiving medium having a minimum length in the conveying direction, and wherein when the image is formed on the image receiving medium of the maximum length, the primary fixing section is brought into the non-fixing state, and the transferring section transfers the image to such a position that the transfer is completed when the forward end of the image receiving medium reaches the secondary fixing section, and when the image is formed on the image receiving medium of the minimum length, the primary fixing section is brought into the fixing state, and the transfer section transfers the image to such a position that the transfer is completed when the forward end of the image receiving medium reaches the primary fixing section.

2. The image forming apparatus according to claim 1, further comprising an intermediate conveying section that is disposed between the primary fixing section and the secondary fixing section and is capable of bringing the image receiving medium into a nipping state where the image receiving medium is nipped and conveyed and into a release state.

3. The image forming apparatus according to claim 2,wherein when the image is recorded on the image receiving medium of the maximum length, the intermediate conveying section is brought into the release state until at least transfer is completed.

4. The image forming apparatus according to claim 2,wherein when the image is formed on the image receiving medium whose length in the conveying direction is shorter than the length of the image receiving medium having the maximum length and longer than the length of the image receiving medium having the minimum length, the transferring section provides a margin at a rear end of the image receiving medium in the conveying direction and transfers the image to the image receiving medium, and brings the primary fixing means into the non-fixing state, and the intermediate conveying section is initially in the release state, and brought into the nipping state after the transfer in the transferring section has been completed.

5. The image forming apparatus according to claim 2, wherein when the image is formed on the image receiving medium whose length in the conveying direction is shorter than the length of the image receiving medium having the maximum length and longer than the length of the image receiving medium having the minimum length, the intermediate conveying section is initially in the release state, and gradually brought into the nipping state after the forward end of the image receiving medium has reached the intermediate conveying section.

6. The image forming apparatus according to claim 2, wherein when a plurality of images are located at intervals in the conveying direction and formed on the image receiving medium whose length in the conveying direction is shorter than the length of the image receiving medium having the maximum length and longer than the length of the image receiving medium having the minimum length, the intermediate conveying section is initially in the release state, and brought into the nipping state at the time when the image receiving medium reaches the intermediate conveying section, and the transfer position is located between the images in the conveying direction.

* * * * *